US010655637B2

(12) United States Patent
Iwakiri et al.

(10) Patent No.: US 10,655,637 B2
(45) Date of Patent: May 19, 2020

(54) SCROLL CASING AND CENTRIFUGAL COMPRESSOR

(71) Applicant: MITSUBISHI HEAVY INDUSTRIES, LTD., Tokyo (JP)

(72) Inventors: Kenichiro Iwakiri, Tokyo (JP); Isao Tomita, Tokyo (JP); Takashi Shiraishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 148 days.

(21) Appl. No.: 15/578,022

(22) PCT Filed: Oct. 29, 2015

(86) PCT No.: PCT/JP2015/080493

§ 371 (c)(1),
(2) Date: Nov. 29, 2017

(87) PCT Pub. No.: WO2017/072899

PCT Pub. Date: May 4, 2017

(65) Prior Publication Data

US 2018/0291922 A1 Oct. 11, 2018

(51) Int. Cl.
*F04D 29/44* (2006.01)
*F04D 29/66* (2006.01)
(Continued)

(52) U.S. Cl.
CPC ..... *F04D 29/441* (2013.01); *F04D 17/10* (2013.01); *F04D 29/4206* (2013.01);
(Continued)

(58) Field of Classification Search
CPC ..... F04D 29/441; F04D 29/667; F04D 29/44; F04D 29/442; F04D 29/4206;
(Continued)

(56) References Cited

U.S. PATENT DOCUMENTS

2004/0126228 A1 7/2004 Roudnev et al.
2007/0113551 A1 5/2007 Arnold et al.
(Continued)

FOREIGN PATENT DOCUMENTS

CN 101421520 A 4/2009
CN 102933855 A 2/2013
(Continued)

OTHER PUBLICATIONS

Chinese Office Action and Search Report, dated Jan. 25, 2019, for Chinese Application No. 201580080304.6, with an English translation.
(Continued)

*Primary Examiner* — Dwayne J White
*Assistant Examiner* — Danielle M. Christensen
(74) *Attorney, Agent, or Firm* — Birch, Stewart, Kolasch & Birch, LLP.

(57) ABSTRACT

A scroll casing forms a scroll flow passage of a centrifugal compressor, and, provided that, in a cross section of the scroll flow passage, Eo is an outer end of the scroll flow passage in a radial direction of the centrifugal compressor, Ef is a front end of the scroll flow passage in an axial direction of the centrifugal compressor, and Mw is a middle point of a maximum flow-passage width Wmax of the scroll flow passage in the radial direction, a flow passage height H of the scroll flow passage in the axial direction gradually increases from a position of the outer end Eo to a position of the front end Ef with respect to the radial direction, and the scroll flow passage has a recirculation flow suppressing cross section in which the front end Ef is disposed on an inner side, in the radial direction, of the middle point Mw, in a section disposed at least partially in a region closer to a scroll start than a connection position of the scroll start and a scroll end.

18 Claims, 22 Drawing Sheets

(51) Int. Cl.
*F04D 29/42* (2006.01)
*F04D 17/10* (2006.01)

(52) U.S. Cl.
CPC ..... *F04D 29/44* (2013.01); *F04D 29/667* (2013.01); *F04D 29/442* (2013.01)

(58) Field of Classification Search
CPC ..... F04D 17/10; F04D 5/008; F05D 2210/40; F05D 2210/43; F05D 2240/14; F05D 2250/32; F05D 2250/70; F05D 2250/73; F05D 2270/101; F05D 2270/10
See application file for complete search history.

(56) References Cited

U.S. PATENT DOCUMENTS

| | | | | |
|---|---|---|---|---|
| 2009/0185897 | A1* | 7/2009 | Battig | F01D 25/04 415/119 |
| 2013/0039750 | A1 | 2/2013 | Osuka et al. | |
| 2013/0266432 | A1 | 10/2013 | Iwakiri et al. | |
| 2016/0281734 | A1* | 9/2016 | Musgrave | F04D 25/024 |

FOREIGN PATENT DOCUMENTS

| | | | |
|---|---|---|---|
| DE | 102007023142 | A1 | 11/2008 |
| EP | 2871369 | A1 | 5/2015 |
| GB | 1153345 | A | 5/1969 |
| JP | 200-64994 | A | 3/2000 |
| JP | 2000-213496 | A | 8/2000 |
| JP | 2005-2951 | A | 1/2005 |
| JP | 2007-309169 | A | 11/2007 |
| JP | 4492045 | B2 | 6/2010 |
| JP | 2012-140900 | A | 7/2012 |
| JP | 2012-184758 | A | 9/2012 |
| JP | 5479316 | B2 | 2/2014 |
| JP | 2014-58890 | A | 4/2014 |
| JP | 2015-183670 | A | 10/2015 |

OTHER PUBLICATIONS

English Translation of the Written Opinion of the International Searching Authority dated Mar. 2, 2018 in corresponding International Application No. PCT/JP2015/080493.
International Search Report of PCT/JP2015/080493 dated Feb. 2, 2016.
European Office Action for European Application No. 15907263.6, dated Apr. 24, 2019.
Extended European Search Report, dated Jul. 16, 2018, for European Application No. 15907263.6.
Chinese Office Action, dated Oct. 21, 2019, for Chinese Application No. 201580080304.6, along with an English machine translation.

* cited by examiner

COMPARATIVE EXAMPLE

EMBODIMENT

SCROLL CASING AND CENTRIFUGAL COMPRESSOR

TECHNICAL FIELD

The present disclosure relates to a scroll casing and a centrifugal compressor.

BACKGROUND ART

The centrifugal compressor used in a compressor part or the like of a turbocharger for an automobile or a ship imparts kinetic energy to a fluid through rotation of an impeller and discharges the fluid outward in the radial direction, thereby achieving a pressure increase by utilizing the centrifugal force.

Such a centrifugal compressor is provided with various features to meet the need to improve the pressure ratio and the efficiency in a broad operational range.

In typical art, for instance, Patent Document 1 discloses a centrifugal compressor provided with a casing having a scroll flow passage formed to have a spiral shape, wherein the height of the scroll flow passage in the axial direction increases gradually from inside toward outside in the radial direction, and reaches its maximum on the radially outer side of the middle point of the flow passage width with respect to the radial direction.

CITATION LIST

Patent Literature

Patent Document 1: JP4492045B

SUMMARY

Problems to be Solved

FIG. 24 is a schematic diagram of a scroll flow passage 004 in the axial directional view of the centrifugal compressor according to a comparative example. FIG. 25 is a diagram of the scroll flow passage of the centrifugal compressor shown in FIG. 24, showing a cross-sectional shape of the flow passage overlapping at each predetermined angle $\Delta\theta$ from the connection position (tongue section position) P of a scroll start 004*a* and a scroll end 004*b* toward the downstream side (scroll start side). The cross-sectional shape of the scroll flow passage in the centrifugal compressor is generally formed in a circular shape over the entire periphery of the scroll flow passage as shown in FIG. 25.

At the small flow-rate operation point of the centrifugal compressor, the flow inside the scroll flow passage becomes a speed reduction flow from the scroll start to the scroll end of the scroll flow passage, and the pressure at the scroll start is lower than the pressure at the scroll end. Thus, in the scroll flow passage, a recirculation flow fc from the scroll end to the scroll start is generated at the tongue section position P (see FIG. 24). Such a recirculation flow causes separation as a result of the main flow being drawn into a flow-passage connection part rapidly, which is one of the main causes of generation of high loss.

Furthermore, according to findings of the present inventors, as shown in FIGS. 26 and 27A to 27C, the flow fd from the diffuser outlet 8*a* forms a swirl flow along the flow passage wall of the scroll flow passage 004, and thus, at the scroll start 004*a* of the scroll flow passage formed to have a circular cross section in the comparative example, the flow from the diffuser outlet deviates toward a region Do on the radially outer side of the flow passage cross section of the scroll flow passage (in the example shown in FIGS. 26 and 27A to 27C, the flow from the diffuser outlet is deviated to the region Do at an angular position of $\theta=0$ degree and an angular position of $\theta=15$ degrees, provided that $\theta$ is 0 degree at the tongue section position P, and $\theta$ is an angular position downstream from the tongue section). Accordingly, at the scroll start in the scroll flow passage, as shown in FIG. 28, the recirculation flow fc enters easily into the region Di on the radially inner side, where scroll flow passage is not filled with the flow from the diffuser outlet, which increases the flow rate of the recirculation flow and causes an increase in the loss that accompanies the recirculation flow.

Although Patent Document 1 discloses a technique to improve the characteristics of the swirl flow in the scroll flow passage by forming the scroll flow passage to have a special non-circular shape in cross section, it does not disclose an approach for suppressing a recirculation flow in the vicinity of the tongue section.

The present invention was made in view of the above, and an object of the present invention is to provide a scroll casing capable of improving the compressor performance by reducing the loss that accompanies a recirculation flow, and a centrifugal compressor having the same.

Solution to the Problems (1) A scroll casing according to at least one embodiment of the present invention is a scroll casing which forms a scroll flow passage of a centrifugal compressor, and provided that, in a cross section of the scroll flow passage, Eo is an outer end of the scroll flow passage in a radial direction of the centrifugal compressor, Ef is a front end of the scroll flow passage in an axial direction of the centrifugal compressor, and Mw is a middle point of a maximum flow-passage width Wmax of the scroll flow passage in the radial direction, a flow passage height H of the scroll flow passage in the axial direction gradually increases from a position of the outer end Eo to a position of the front end Ef with respect to the radial direction, and the scroll flow passage has a recirculation flow suppressing cross section in which the front end Ef is disposed on an inner side, in the radial direction, of the middle point Mw, in a section disposed at least partially in a region closer to a scroll start than a connection position of the scroll start and a scroll end.

With the above scroll casing (1), in the section disposed at least partially in the region closer to the scroll start than the connection position of the scroll start and the scroll end in the scroll flow passage, the scroll flow passage has the recirculation flow suppressing cross section, where the front end Ef is disposed on the inner side of the middle point Mw in the radial direction, and thereby it is possible to make the flow-passage wall portion connecting the outer end Eo and the front end Ef more flat, compared to the comparative example (which has a circular cross section where the front end Ef coincides with the middle point Mw over the entire region of the scroll flow passage in the circumferential direction).

Thus, compared to the above comparative example, it is possible to make it easier to guide the fluid discharged from the diffuser outlet to the region on the radially inner side (inner side in the radial direction) in the scroll flow passage, and to suppress deviation of a flow to a radially outer region at the scroll start of the scroll flow passage effectively.

Thus, compared to the above comparative example, it is more difficult for the recirculation flow to enter the region on the radially inner side of the scroll flow passage, and thereby it is possible to suppress generation of the recirculation flow and to suppress generation of loss that accompanies the recirculation flow. Accordingly, it is possible to improve the performance (efficiency) of the centrifugal compressor. Furthermore, since generation of the recirculation flow is suppressed, it is possible to reduce the flow-passage cross-sectional area of the scroll flow passage required, and to reduce the size of the scroll casing.

It is known that the recirculation flow has low energy and tends to accumulate at the center of the cross section of the scroll flow passage, and at occurrence of surge that limits the operational limit of the compressor at a low air flow side, a reverse flow occurs from the center part of the scroll cross section where the low energy fluid is accumulated. In this regard, the recirculation flow suppressing cross section is applied to the section disposed at least partially in the region closer to the scroll start than the connection position (tongue section position) in the scroll flow passage, and thereby generation of the recirculation flow is suppressed, which makes it possible to make the energy distribution uniform in the cross section of the scroll flow passage and to bring about improvement of the surge characteristics (achievement of a wider range).

(2) A scroll casing according to at least one embodiment of the present invention is a scroll casing which forms a scroll flow passage of a centrifugal compressor, and provided that, in a cross section of the scroll flow passage, Eo is an outer end of the scroll flow passage in a radial direction of the centrifugal compressor, Ef is a front end of the scroll flow passage in an axial direction of the centrifugal compressor, and Mh is a middle point of a maximum flow-passage height Hmax of the scroll flow passage in the axial direction, a flow passage width W of the scroll flow passage in the radial direction gradually increases from a position of the front end Ef to a position of the outer end Eo with respect to the axial direction, and the scroll flow passage has a recirculation flow suppressing cross section in which the outer end Eo is disposed on a back side, in the axial direction, of the middle point Mh, in a section disposed at least partially in a region closer to a scroll start than a connection position of the scroll start and a scroll end.

With the above scroll casing (2), in the section disposed at least partially in the region closer to the scroll start than the connection position of the scroll start and the scroll end in the scroll flow passage, the scroll flow passage has the recirculation flow suppressing cross section, where the outer end Eo is disposed on the back side of the middle point Mh in the axial direction, and thereby it is possible to make the flow-passage wall portion connecting the outer end Eo and the front end Ef more flat, compared to the comparative example (which has a circular cross section where the front end Ef coincides with the middle point Mw over the entire region of the scroll flow passage in the circumferential direction).

Thus, compared to the above comparative example, it is possible to make it easier to guide the fluid discharged from the diffuser outlet to the region Di on the radially inner side (inner side in the radial direction) of the scroll flow passage 4, and to suppress deviation of a flow to a radially outer region at the scroll start of the scroll flow passage effectively.

Thus, compared to the above comparative example, it is more difficult for the recirculation flow to enter the region on the radially inner side of the scroll flow passage, and thereby it is possible to suppress generation of the recirculation flow and to suppress generation of loss that accompanies the recirculation flow, similarly to the above configuration (1). Furthermore, since generation of the recirculation flow is suppressed, it is possible to reduce the flow-passage cross-sectional area of the scroll flow passage required, and to reduce the size of the scroll casing. Furthermore, it is possible to achieve the effect to reduce the size of the above described scroll casing and the effect to improve the surge characteristics (achievement of a wider range). However, the above configuration (1) has a merit of reducing pressure loss more easily than the above configuration (2), for it is easier to obtain a configuration in which the fluid discharged to the scroll flow passage from the diffuser outlet is guided smoothly to the region on the inner side in the radial direction.

(3) In some embodiments, in the above scroll casing (1), a flow passage width W of the scroll flow passage in the radial direction gradually increases from a position of the front end Ef toward a position of the outer end Eo with respect to the axial direction. Furthermore, provided that, in the cross section of the scroll flow passage, Mh is a middle point of a maximum flow-passage height Hmax of the scroll flow passage in the axial direction, in the recirculation flow suppressing cross section, the outer end Eo is disposed on a back side, in the axial direction, of the middle point Mh.

With the above scroll casing (3), for having both of the features described in the above (1) and (2), it is easier to make the flow-passage wall portion connecting the outer end Eo and the front end Ef more flat, and to achieve a greater effect to make it easier to guide the fluid discharged from the diffuser outlet to the region on the radially inner side of the scroll flow passage.

Thus, it is even more difficult for the recirculation flow to enter the region on the radially inner side of the scroll flow passage, and thereby it is possible to enhance the effect to suppress generation of the recirculation flow and generation of loss that accompanies the recirculation flow. Furthermore, corresponding to the high effect to suppress the recirculation flow, it is also possible to enhance the above effect to reduce the size of the above described scroll casing and to improve the surge characteristics (achievement of a wider range).

(4) In some embodiments, in the scroll casing described in the above (1) or (3), at least in a part of a section of the scroll flow passage having the recirculation flow suppressing cross section, the maximum flow-passage width Wmax and a distance $\Delta r$ between the front end Ef and the middle point Mw in the radial direction satisfies $\Delta r \geq 0.1 \times Wmax$.

With the above scroll casing (4), it is possible to enhance the effect to make it easier to guide the fluid discharged from the diffuser outlet to the region on the radially inner side of the scroll flow passage, and to suppress generation of a recirculation flow effectively.

(5) In some embodiments, in the scroll casing described in the above (2) or (3), at least in a part of a section of the scroll flow passage having the recirculation flow suppressing cross section, the maximum flow-passage height Hmax and a distance $\Delta z$ between the outer end Eo and the middle point Mh in the axial direction satisfies $\Delta z \geq 0.1 \times Hmax$.

With the above scroll casing (5), it is possible to enhance the effect to make it easier to guide the fluid discharged from the diffuser outlet to the region closer to the radially inner side of the scroll flow passage, and to suppress generation of a recirculation flow effectively.

(6) In some embodiments, in the scroll casing described in any one of the above (1) to (5), provided that an angular position about a scroll center of the scroll flow passage is zero degree at the connection position and the angular position is $\theta$ at a position closer to the scroll start than the connection position, the recirculation flow suppressing cross section is disposed in at least a part of a section from θ=zero degree to θ=120 degrees in the scroll flow passage.

With the above scroll casing (6), by applying the recirculation flow suppressing cross section to the section closer to the scroll start than the connection position but still close to the connection position in the scroll flow passage, it is possible to suppress deviation of the above described flow to the region on the radially outer side at the scroll start of the scroll flow passage effectively. Accordingly, it is possible to suppress generation of the recirculation flow effectively.

(7) In some embodiments, in the scroll casing described in any one of the above (1) to (6), provided that an angular position about a scroll center of the scroll flow passage is zero degree at the connection position and the angular position is θ at a position closer to the scroll start than the connection position, the recirculation flow suppressing cross section is disposed from θ=zero degree to a first angular position θ1 in the scroll flow passage.

With the above scroll casing (7), by applying the recirculation flow suppressing cross section to the section closer to the scroll start starting from the connection position in the scroll flow passage, it is possible to suppress deviation of the flow to the region on the radially outer side at the scroll start of the scroll flow passage effectively. Accordingly, it is possible to suppress generation of the recirculation flow effectively.

(8) In some embodiments, in the above scroll casing (7), the first angular position θ1 is an angular position of not less than 10 degrees.

According to findings of the present inventors, by applying the recirculation flow suppressing cross section to the section before the fluid discharged from the diffuser outlet swirls at least approximately once about the cross-sectional center of the scroll flow passage in the vicinity of the connection position (scroll start side) in the scroll flow passage, it is possible to more effectively suppress deviation of the flow to the region on the radially outer side at the scroll start of the scroll flow passage. While the distance the fluid discharged from the diffuser outlet requires to complete approximately one rotation changes depending on the operational conditions, with the first angular position θ1 being a position of not less than 10 degrees (more preferably, not less than 30 degrees) as described in the above (8), it is possible to suppress deviation of the flow to the region on the radially outer side at the scroll start of the scroll flow passage more effectively, and to suppress generation of the recirculation flow more effectively.

(9) In some embodiments, in the scroll casing described in any one of the above (1) to (8), the scroll flow passage includes a section having a circular cross-sectional shape at downstream of the section having the recirculation flow suppressing cross section.

With the above scroll casing (9), compared to the comparative example in which the entire section of the scroll flow passage has a circular cross-sectional shape, it is possible to guide the flow from the diffuser outlet at an earlier stage to the above described region (the radially inner region at the scroll start of the scroll flow passage), where the flow is typically unlikely to enter, and to form a smooth swirl flow with the circular cross-sectional shape in the section separated downstream (toward the scroll start side) from the connection position P to some extent, and thereby it is possible to reduce flow loss inside the scroll flow passage while reducing the amount of the recirculation flow. Accordingly, in the entire operational range at the small flow rate side, the large flow rate side, the low rotation side and the high rotation side, it is possible to reduce the pressure loss coefficient.

(10) In some embodiments, in the scroll casing described in any one of the above (1) to (5), the recirculation flow suppressing cross section is disposed over an entire region in a circumferential direction of the scroll flow passage.

Also with the above scroll casing (10), it is possible to suppress deviation of the flow to the region on the radially outer side at the scroll start of the scroll flow passage effectively, and thereby it is possible to suppress generation of the recirculation flow and to suppress generation of loss that accompanies the recirculation flow. Furthermore, since generation of the recirculation flow is suppressed, it is possible to reduce the flow-passage cross-sectional area of the scroll flow passage required, and to reduce the size of the scroll casing. Furthermore, it is possible to improve the surge characteristics (achieve a wider range), similarly.

(11) In some embodiments, in the scroll casing according to any one of the above (1) to (10), in the cross section of the scroll flow passage, in a case where Lz is a line passing through a middle point Mw of a maximum flow-passage width Wmax of the scroll flow passage in the radial direction and parallel to the axial direction, Lr is a line passing through a middle point Mh of a maximum flow-passage height Hmax of the scroll flow passage in the axial direction and parallel to the radial direction, and the recirculation flow suppressing cross section is divided into four regions by the line Lz and the line Lr, provided that, of the four regions, A1 is an area of a region positioned on an outer side in the radial direction and on a back side in the axial direction of an intersection C of the line Lz and the line Lr, A2 is an area of a region positioned on the outer side in the radial direction and on a front side in the axial direction of the intersection, and A3 is an area of a region positioned on an inner side in the radial direction and on a front side in the axial direction of the intersection, the area A1, the area A2, and the area A3 satisfy A1>A2 and A3>A2, in at least a part of a section of the scroll flow passage, the section having the recirculation flow suppressing cross section.

With the above scroll casing (11), it is possible to make the flow-passage wall portion connecting the outer end Eo and the front end Ef more flat, compared to the comparative example (which has a circular cross section that satisfies A1=A2=A3), and to make it easier to guide the fluid discharged from the diffuser outlet to the region on the radially inner side of the scroll flow passage. Thus, compared to the above comparative example, it is more difficult for the recirculation flow to enter the region on the radially inner side of the scroll flow passage. Thus, it is possible to suppress generation of the recirculation flow and to suppress generation of loss that accompanies the recirculation flow.

(12) In some embodiments, in the scroll casing according to any one of the above (1) to (11), in the cross section of the scroll flow passage, in a case where Lz is a line passing through a middle point Mw of a maximum flow-passage width Wmax of the scroll flow passage in the radial direction of the centrifugal compressor and parallel to the axial direction, Lr is a line passing through a middle point Mh of a maximum flow-passage height Hmax of the scroll flow passage in the axial direction and parallel to the radial direction, and the recirculation flow suppressing cross section is divided into four regions by the line Lz and the line Lr, a flow-passage wall of a region positioned on an outer side in the radial direction and on a back side in the axial direction of an intersection C of the line Lz and the line Lr, of the four regions, includes an arc portion having a first curvature radius R1, a flow-passage wall of a region positioned on an outer side in the radial direction and on a front side in the axial direction of the intersection C, of the four regions, includes an arc portion having a second curvature radius R2 which is greater than the first curvature radius R1, and a flow-passage wall of a region positioned on an inner side in the radial direction and on a front side in the axial direction of the intersection C, of the four regions, includes an arc portion having a third curvature radius R3 which is smaller than the second curvature radius R2.

With the above scroll casing (12), the arc portion of the flow-passage wall portion belonging to the region D2 is closer to flat than the arc portion a1 belonging to the region D1 and the arc portion belonging to the region D3, compared to the comparative example (which has a circular cross section that satisfies R1=R2=R3), and thus it is possible to make it easier to guide the fluid discharged from the diffuser outlet to the region on the radially inner side of the scroll flow passage. Thus, compared to the above comparative example, it is more difficult for the recirculation flow to enter the region on the radially inner side of the scroll flow passage, and thereby it is possible to suppress generation of the recirculation flow and to suppress generation of loss that accompanies the recirculation flow.

(13) In some embodiments, in the scroll casing described in any one of the above (1) to (12), provided that R is a distance between a centroid of the recirculation flow suppressing cross section and a scroll center of the scroll flow passage, the scroll flow passage includes, in a section disposed at least partially in a region closer to the scroll start than the connection position of the scroll start and the scroll end, a centroid position shift section where the distance R decreases from a downstream side toward the connection position, and the section including the recirculation flow suppressing cross section and the centroid position shift section overlap with each other at least partially.

With the above scroll casing (13), in the centroid position shift section in the scroll flow passage, the distance between the centroid of the cross section and the axis of the centrifugal compressor reduces toward the connection position from the downstream side, and thus it is possible to enhance the above effect (achieved by applying the recirculation flow suppressing cross section) to make it easier to guide the fluid discharged from the diffuser outlet to the region on the radially inner side of the scroll flow passage. Accordingly, it is possible to effectively suppress deviation of the flow to the region on the radially outer side at the scroll start of the scroll flow passage.

(14) In some embodiments, in the scroll casing described in the above (13), provided that an angular position about the scroll center of the scroll flow passage is zero degree at the connection position and the angular position at a position closer to the scroll start than the connection positions is θ, the centroid position shift section is disposed at least partially in a section from θ=zero degree to θ=120 degrees in the scroll flow passage.

With the above scroll casing (14), by providing the centroid position shift section in the section closer to the scroll start than the connection position but still close to the connection position in the scroll flow passage, it is possible to suppress deviation of the above described flow to the region on the radially outer side at the scroll start of the scroll flow passage effectively. Accordingly, it is possible to suppress generation of the recirculation flow effectively.

(15) In some embodiments, in the scroll casing described in any one of the above (1) to (14), the centroid position shift section is disposed from θ=zero degree to the second singular position θ2 in the scroll flow passage.

With the above scroll casing (15), by applying the recirculation flow suppressing cross section to the section closer to the scroll start starting from the connection position P in the scroll flow passage, it is possible to suppress deviation of the flow to the region on the radially outer side at the scroll start of the scroll flow passage effectively. Accordingly, it is possible to suppress generation of the recirculation flow effectively.

(16) In some embodiments, in the scroll casing described in the above (15), the second angular position θ2 is an angular position of not less than 10 degrees.

According to findings of the present inventors, by applying the centroid position shift section so as to cover to some extent the section before the fluid discharged from the diffuser outlet swirls at least approximately once about the cross-sectional center of the scroll flow passage in the vicinity of the connection position (scroll start side) in the scroll flow passage, it is possible to effectively suppress deviation of the flow to the region on the radially outer side at the scroll start of the scroll flow passage. While the distance the fluid discharged from the diffuser outlet requires to complete approximately one rotation changes depending on the operational conditions, with the second angular position θ2 being an angular position of not less than 10 degrees (more preferably, not less than 30 degrees), it is possible to suppress deviation of the flow to the region on the radially outer side at the scroll start of the scroll flow passage more effectively, and to suppress generation of the recirculation flow more effectively.

(17) In some embodiments, in the scroll casing described in any one of the above (13) to (16), provided that A is a flow-passage area of the recirculation flow suppressing cross section, in the centroid position shift section, A/R obtained by dividing the flow-passage cross sectional area A by the distance R increases at a substantially constant gradient from the scroll start to the scroll end of the scroll flow passage.

With the above scroll casing (17), in the centroid position shift section, the value A/R increases at a substantially constant gradient from the scroll start to the scroll end of the scroll flow passage, and thus it is possible to enhance the above effect to make it easier to guide the fluid discharged from the diffuser outlet to the region on the radially inner side of the scroll flow passage, while maintaining a constant flow velocity regardless of the angular position θ. Accordingly, it is possible to suppress generation of a recirculation flow effectively while maintaining a constant flow velocity regardless of the angular position θ.

(18) A centrifugal compressor according to at least one embodiment of the present invention comprises: an impeller; and the scroll casing according to any one of the above (1) to (17), the scroll casing being disposed around the impeller and forming a scroll flow passage into which a fluid flows after passing through the impeller.

With the above centrifugal compressor (18), the scroll casing is the scroll casing described in any one of the above (1) to (7), and thus it is possible to suppress generation of a recirculation flow in the scroll flow passage, and to suppress generation of loss that accompanies a recirculation flow. Accordingly, it is possible to improve the performance (efficiency) of the centrifugal compressor.

Advantageous Effects

According to at least one embodiment of the present invention, provided is a scroll casing capable of improving the compressor performance by reducing the loss that accompanies a recirculation flow, and a centrifugal compressor having the same.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
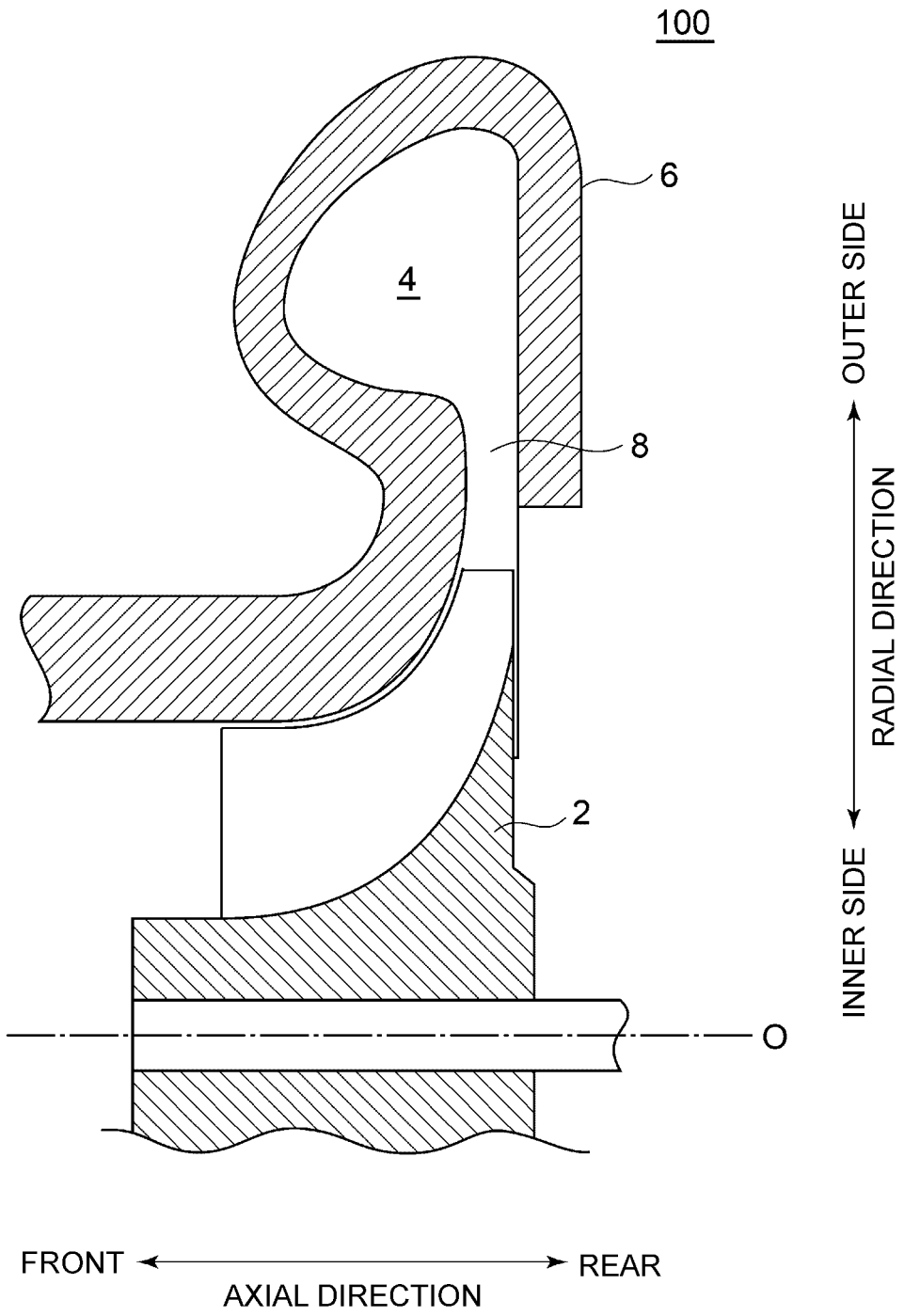
FIG. 1 is a schematic cross-sectional view of a centrifugal compressor 100 according to an embodiment, taken along the axial direction of the compressor 100.

FIG. 1 is a schematic cross-sectional view of a centrifugal compressor 100 according to an embodiment, taken along the axial direction of the compressor 100.

In the present specification, unless otherwise stated, "axial direction" refers to the axial direction of the centrifugal compressor 100, that is, the axial direction of the impeller 2, "front side" in the axial direction refers to the upstream side in the intake direction of the centrifugal compressor 100 with respect to the axial direction, and "back side" in the axial direction refers to the downstream side in the intake direction of the centrifugal compressor 100 with respect to the axial direction. Furthermore, unless otherwise stated, "radial direction" refers to the radial direction of the centrifugal compressor 100, that is, the radial direction of the impeller 2. The centrifugal compressor 100 can be applied to a turbocharger for an automobile or a ship, or other industrial centrifugal compressors and blowers, for instance.

As shown in FIG. 1, the centrifugal compressor 100 includes an impeller 2, and a scroll casing 6 disposed around the impeller 2, the scroll casing 6 forming a scroll flow passage 4 into which a fluid flows after passing through the impeller 2 and a diffuser flow passage 8.

Figure 2:
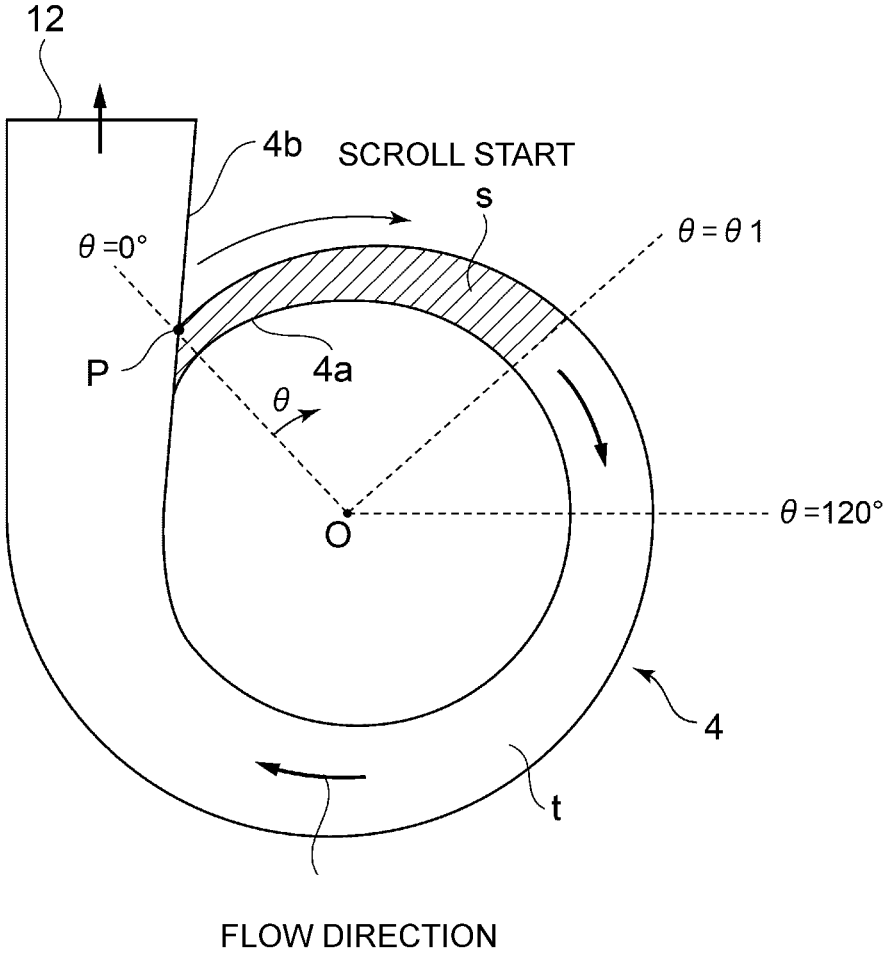
FIG. 2 is a schematic diagram of a scroll flow passage 4 in the axial directional view of the centrifugal compressor 100 according to an embodiment.

FIG. 2 is a schematic diagram of a scroll flow passage 4 in the axial directional view of the centrifugal compressor 100 according to an embodiment.

Figure 24:
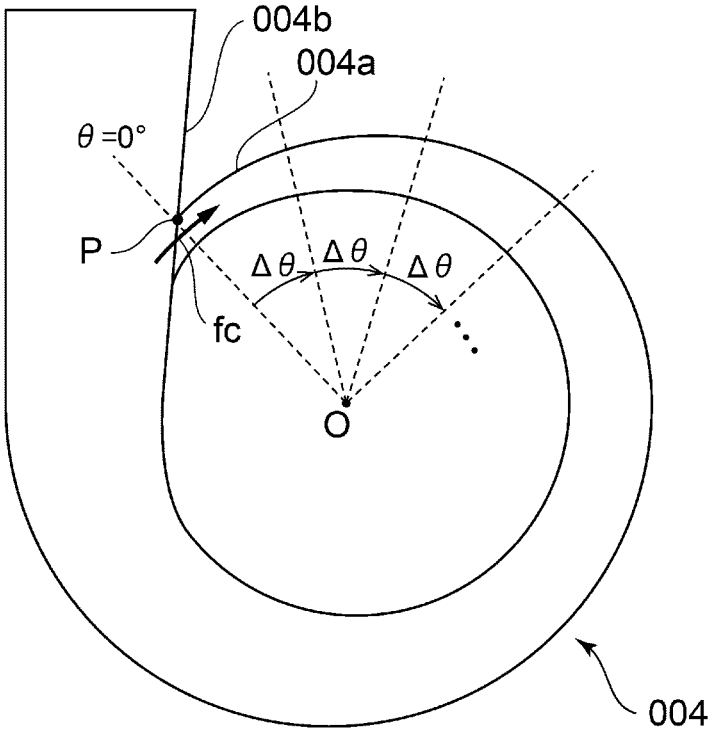
FIG. 24 is a schematic diagram of a scroll flow passage 004 in the axial directional view of the centrifugal compressor according to a comparative example.
Figure 25:
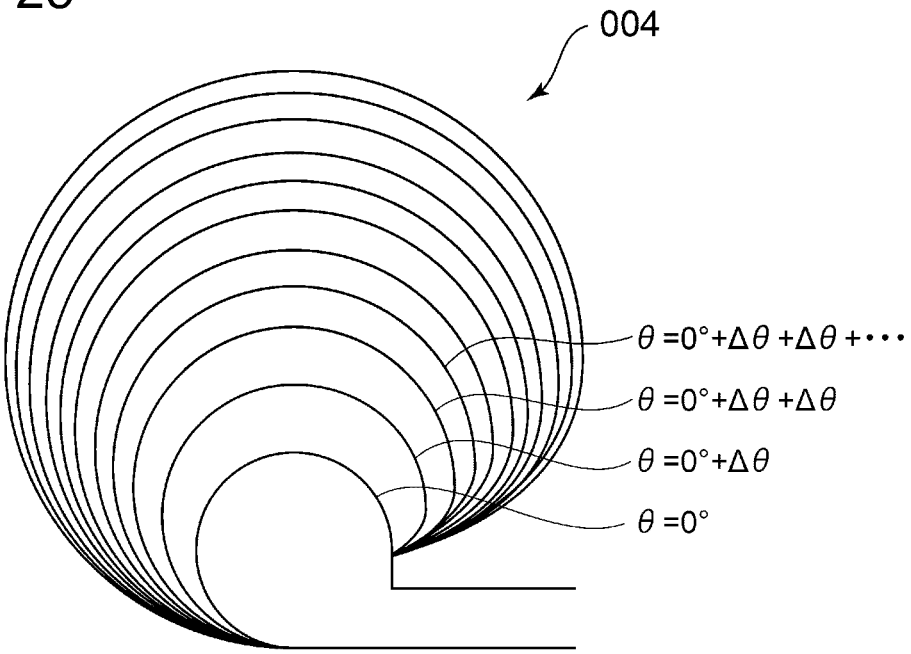
FIG. 25 is a diagram showing the scroll flow passage 004 of the centrifugal compressor of the comparative example, showing a cross-sectional shape of the flow passage overlapping at each predetermined angle Δθ from the connection position (tongue section position) P of the scroll start 004*a* and the scroll end 004*b* toward the downstream side (scroll start side).
Figure 26:
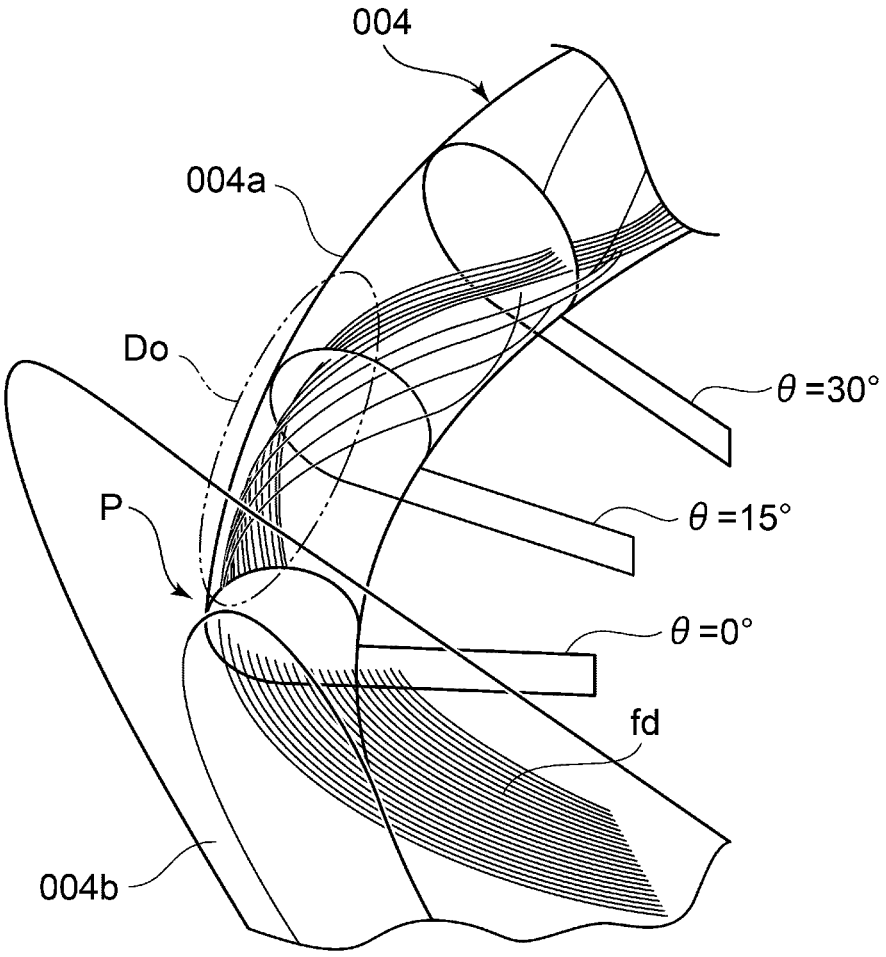
FIG. 26 is a flow line diagram of the diffuser outlet flow fd, showing how the flow fd from the diffuser outlet forms a swirl flow along the flow passage wall of the scroll flow passage 004.
Figure 27A:
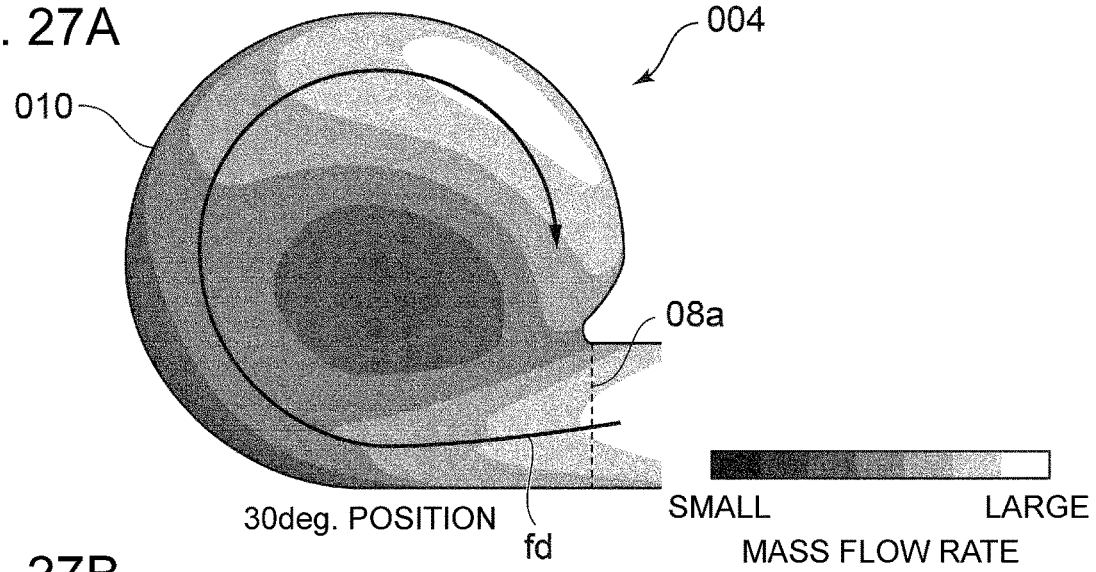
FIG. 27A is a diagram showing the distribution of the mass flow rate of the diffuser outlet flow fd, in a flow-passage cross section of the scroll flow passage 004 at the angular position θ=0° (tongue section position) shown in FIG. 26.
Figure 27B:
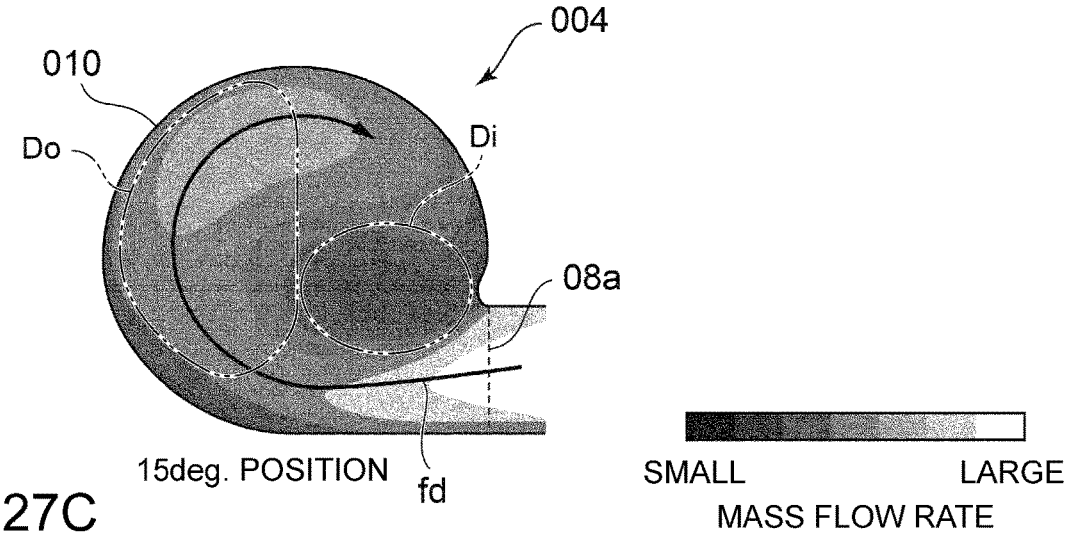
FIG. 27B is a diagram showing the distribution of the mass flow rate of the diffuser outlet flow fd, in a flow-passage cross section of the scroll flow passage 004 at the angular position θ=15° shown in FIG. 26.
Figure 27C:
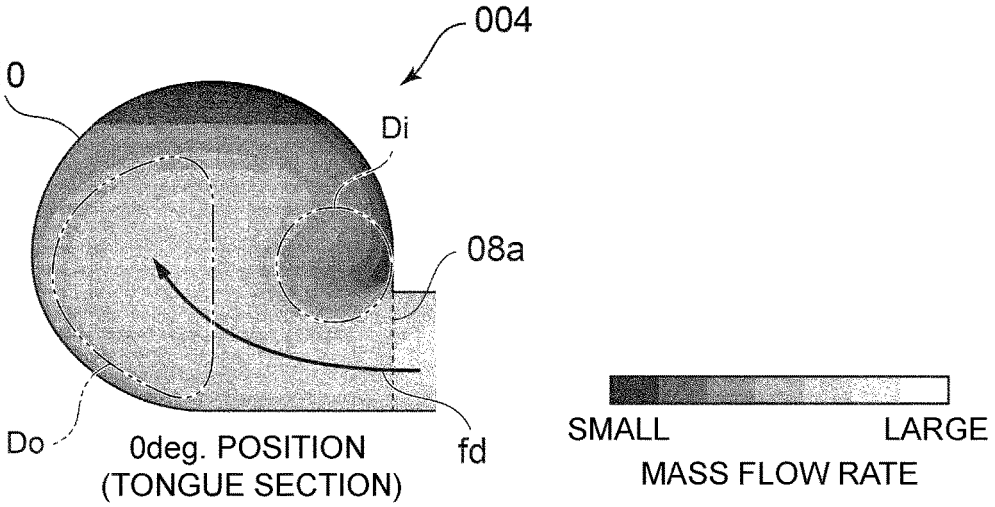
FIG. 27C is a diagram showing the distribution of the mass flow rate of the diffuser outlet flow fd, in a flow-passage cross section of the scroll flow passage 004 at the angular position θ=30° shown in FIG. 26.
Figure 28:
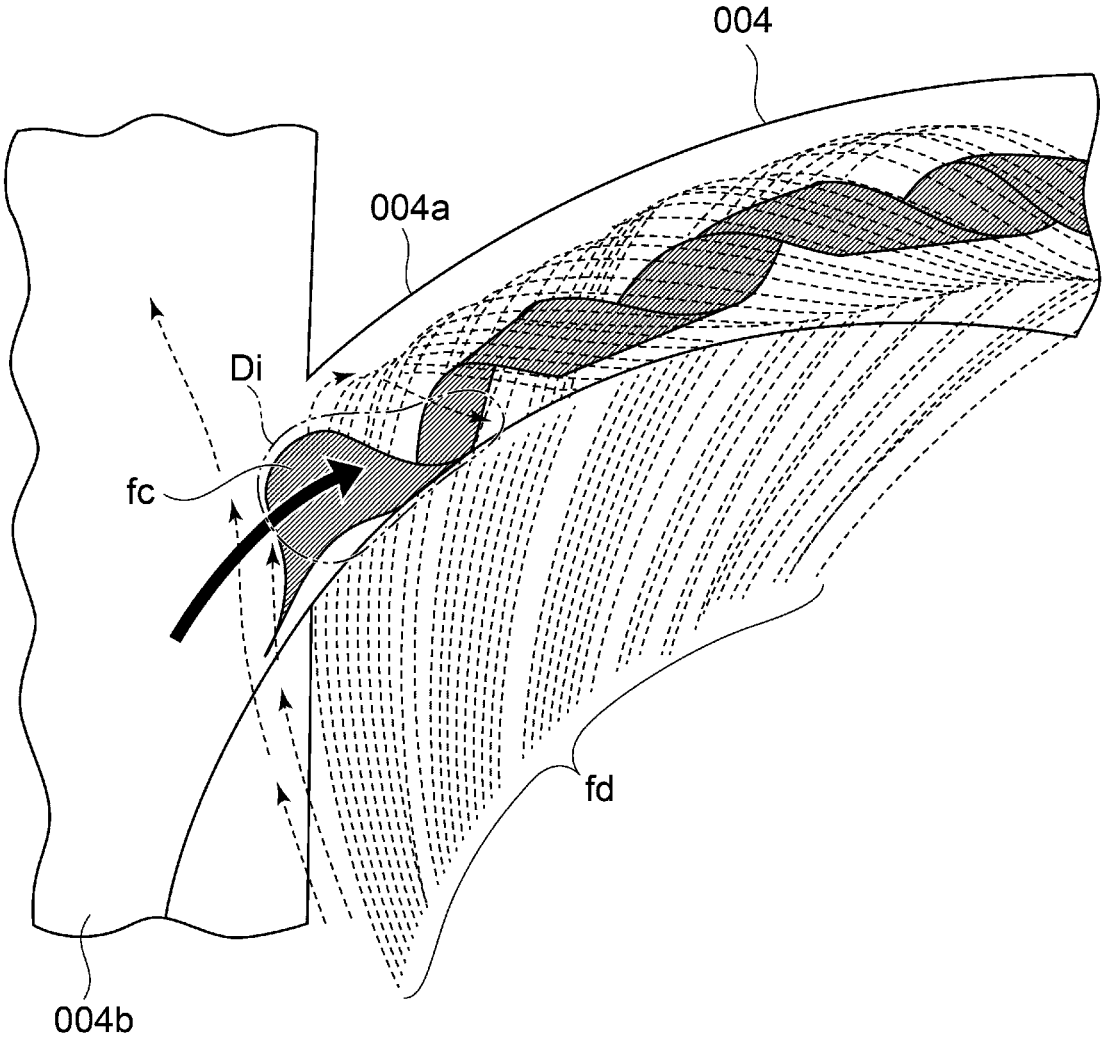
FIG. 28 is a flow line diagram for describing the relationship between the diffuser outlet flow fd and the recirculation flow fc in the scroll flow passage 004.

In an embodiment, the scroll flow passage 4 may have the recirculation flow suppressing cross section 10A described below, in a section 's' disposed at least partially in the region closer to the scroll start 4*a* than the connection position (tongue section) P of the scroll start 4*a* and the scroll end 4*b*. "The region closer to the scroll start 4*a* than the connection position P" herein refers to the region downstream of the connection point P with respect to the flow direction (see arrow fc in FIG. 24) of the recirculation flow.

Figure 3:
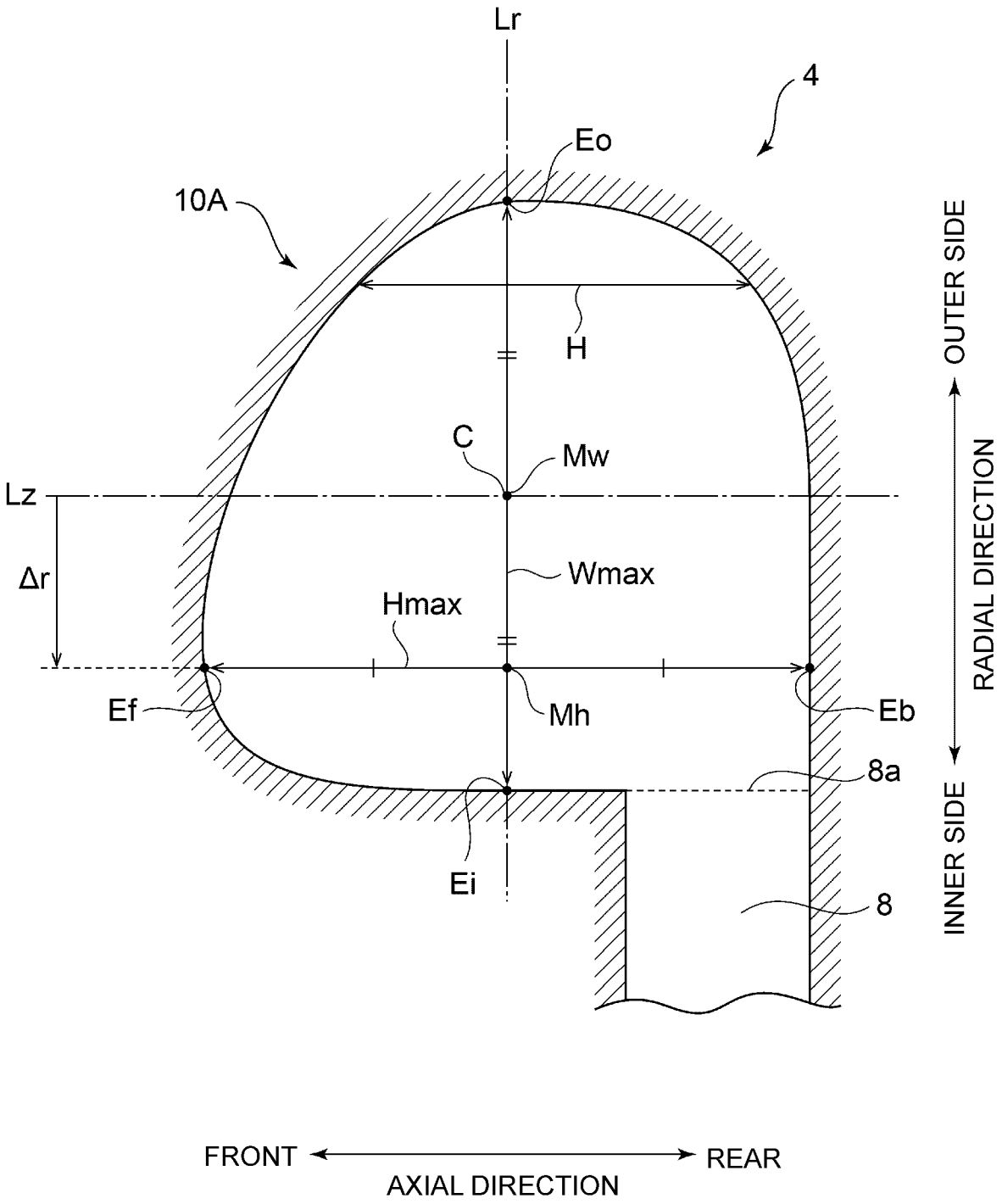
FIG. 3 is a schematic cross-sectional view for describing a shape of a recirculation flow suppressing cross section 10A according to an embodiment.
Figure 4:
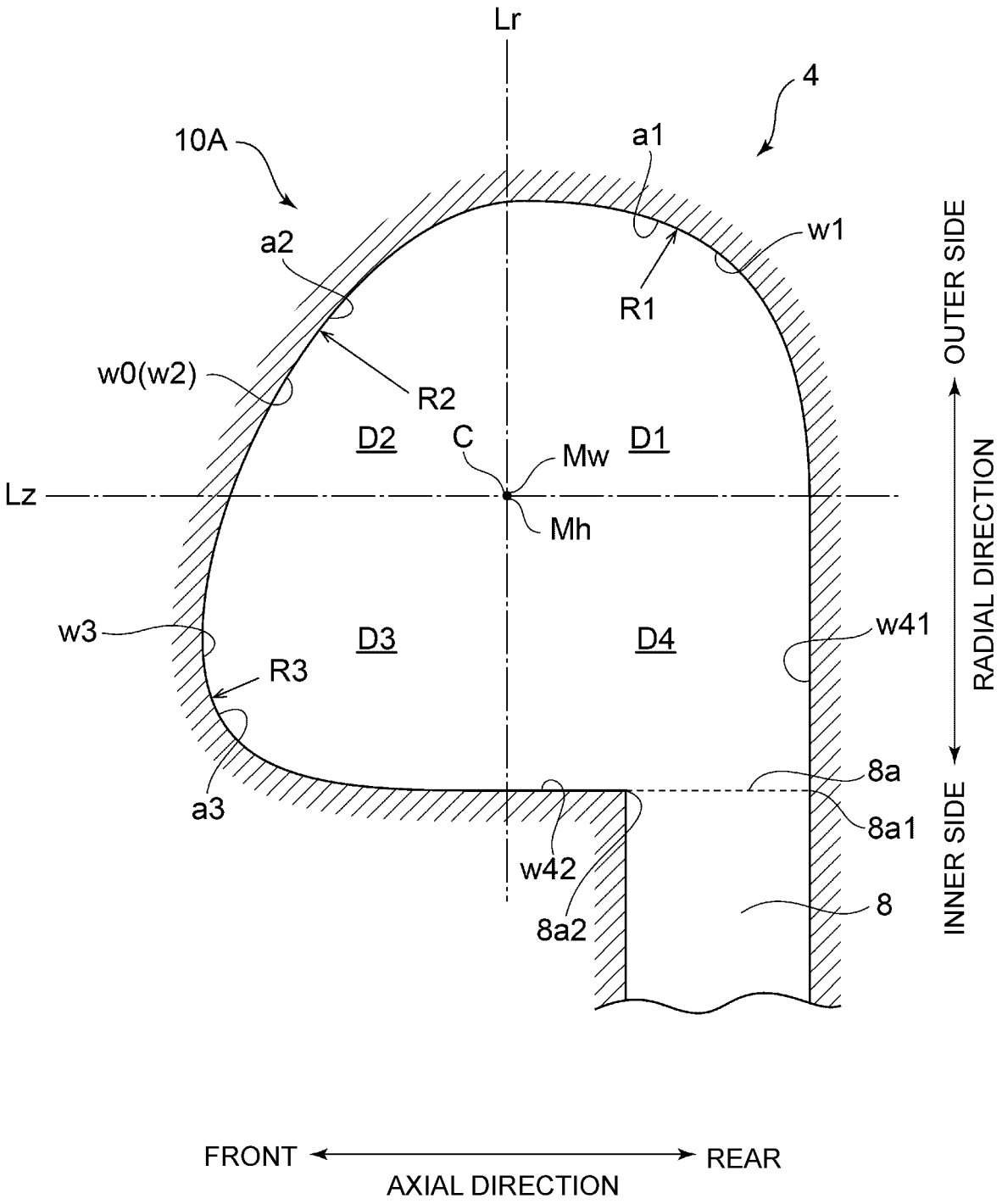
FIG. 4 is a schematic cross-sectional view for describing a shape of a recirculation flow suppressing cross section 10A according to an embodiment.

FIGS. 3 and 4 are each a schematic cross-sectional view for describing a shape of a recirculation flow suppressing cross section 10A according to an embodiment.

As shown in FIG. 3, in the cross section of the scroll flow passage 4, provided that Eo is the outer end of the scroll flow passage 4 in the radial direction, Ef is the front end of the scroll flow passage 4 in the axial direction, and Mw is the middle point of the maximum flow-passage width Wmax of the scroll flow passage 4 in the radial direction, the flow passage height H of the scroll flow passage 4 in the axial direction increases gradually from the position of the outer end Eo in the radial direction to the position of the front end Ef. Furthermore, in the recirculation flow suppressing cross section 10A, the front end Ef is disposed on the inner side of the middle point Mw in the radial direction.

With the above configuration, in the section 's' disposed at least partially in the region closer to the scroll start than the connection position P of the scroll start 4*a* and the scroll end 4*b* in the scroll flow passage 4, the scroll flow passage 4 has the recirculation flow suppressing cross section 10A, where the front end Ef is disposed on the inner side of the middle point Mw in the radial direction, and thereby it is possible to make the flow-passage wall portion w0 connecting the outer end Eo and the front end Ef more flat, compared to the comparative example (which has a circular cross section 010 where the front end Ef coincides with the middle point Mw over the entire region of the scroll flow passage in the circumferential direction).

Figure 5:
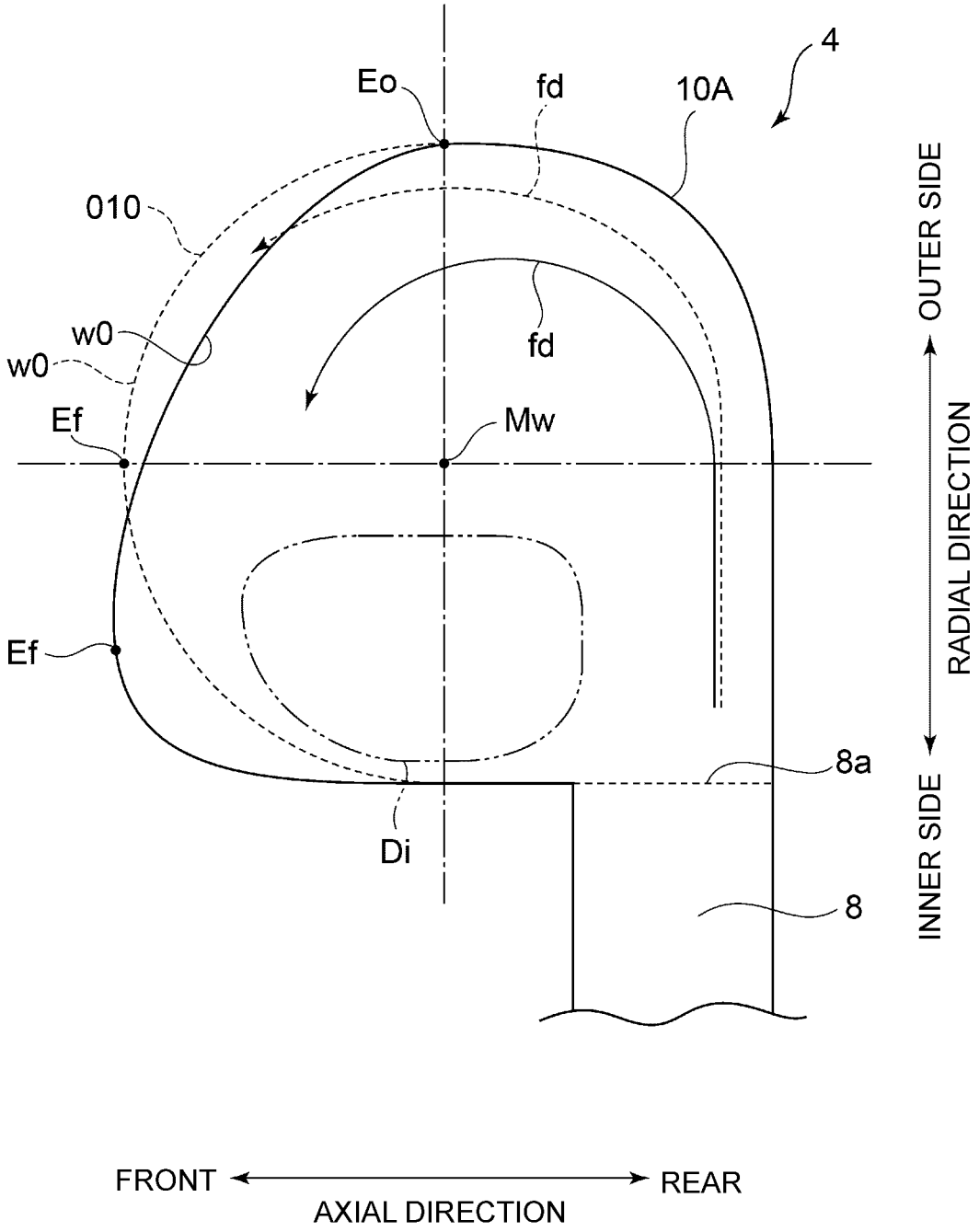
FIG. 5 is a diagram for describing the flow of the fluid fd discharged from a diffuser outlet 8*a*.
Figure 6A:
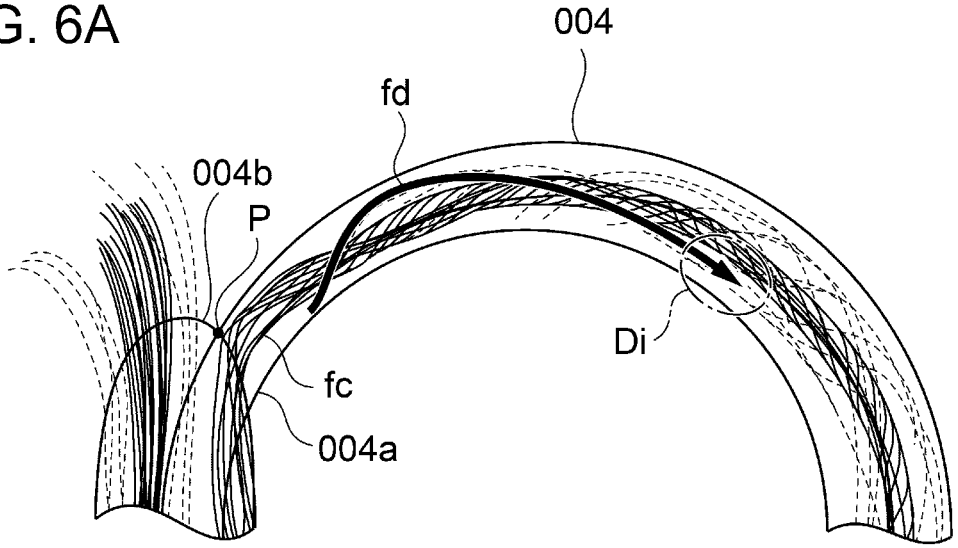
FIG. 6A is a diagram for describing the relationship between the flow of the fluid fd discharged from the diffuser outlet 8*a* and the recirculation flow fc, according to a comparative example.
Figure 6B:
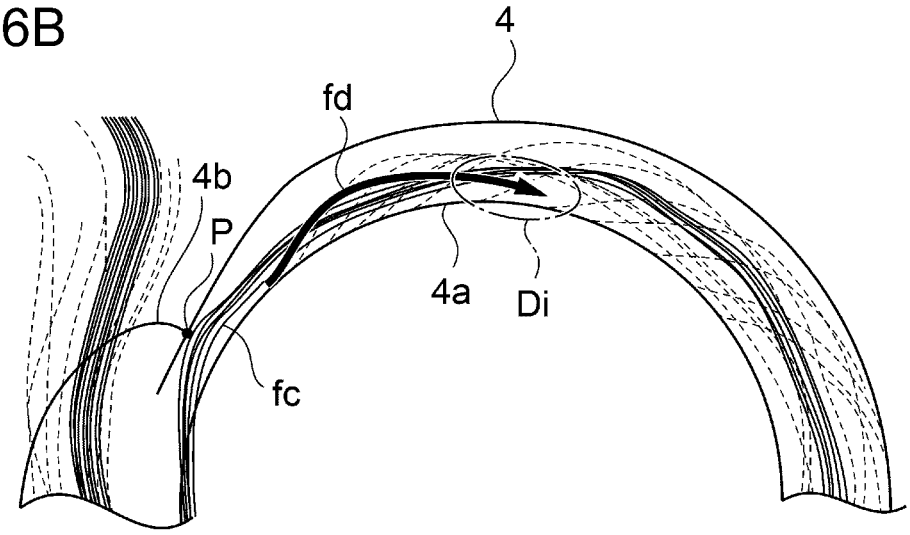
FIG. 6B is a diagram for describing the relationship between the flow of the fluid fd discharged from the diffuser outlet 8*a* and the recirculation flow fc, according to an embodiment.

Thus, as shown in FIGS. 5, 6A, and 6B, as compared to the above comparative example, it is possible to make it easier to guide the flow fd discharged from the diffuser outlet 8*a* to the region Di on the radially inner side (inner side in the radial direction) of the scroll flow passage 4 (in FIG. 5, the solid-line arrow fd represents the flow discharged from the diffuser outlet 8*a* in the recirculation flow suppressing cross section 10A, while the dotted-line arrow fd represents the flow discharged from the diffuser outlet 8*a* in the circular cross section 010 of the comparative example). Accordingly, it is possible to effectively suppress deviation of the flow fd from the diffuser outlet to the region on the radially outer side at the scroll start 4*a* of the scroll flow passage 4, which is the technical problem described above with reference to FIGS. 26 and 27A to 27C.

Thus, compared to the above comparative example, it is more difficult for the recirculation flow fc to enter the region Di on the radially inner side of the scroll flow passage 4, and thereby it is possible to suppress generation of the recirculation flow fc and to suppress generation of loss that accompanies the recirculation flow fc. Furthermore, since generation of the recirculation flow fc is suppressed, it is possible to reduce the flow passage cross-sectional area of the scroll flow passage 4 required, and to reduce the size of the scroll casing 6.

It is known that the recirculation flow has low energy and tends to accumulate at the center of the cross section of the scroll flow passage 4, and at occurrence of surge that limits the operational limit of the compressor at a low air flow side, a reverse flow occurs from the center part of the scroll cross section where the low energy fluid is accumulated. In this regard, the recirculation flow suppressing cross section 10A is applied to the section 's' disposed at least partially in the region closer to the scroll start than the connection position P in the scroll flow passage 4, and thereby generation of the recirculation flow is suppressed, which makes it possible to make the energy distribution uniform in the cross section of the scroll flow passage 4 and to bring about improvement of the surge characteristics (achievement of a wider range).

In an embodiment, at least in a part of the section 's' having the recirculation flow suppressing cross section 10A shown in FIG. 3 formed therein (see FIG. 2), the distance $\Delta r$ between the front end Ef and the middle point Mw in the radial direction and the maximum flow-passage width Wmax may satisfy $\Delta r \geq 0.1 \times Wmax$.

Accordingly, it is possible to enhance the effect to make it easier to guide the fluid discharged from the diffuser outlet 8*a* to the region Di on the radially inner side of the scroll flow passage 4, and to suppress generation of a recirculation flow effectively.

In another embodiment, the scroll flow passage 4 shown in FIG. 2 may have a recirculation flow suppressing cross section 10B described below, instead of the above described recirculation flow suppressing cross section 10A, in a section 's' disposed at least partially in the region closer to the scroll start than the connection position P.

Figure 7:
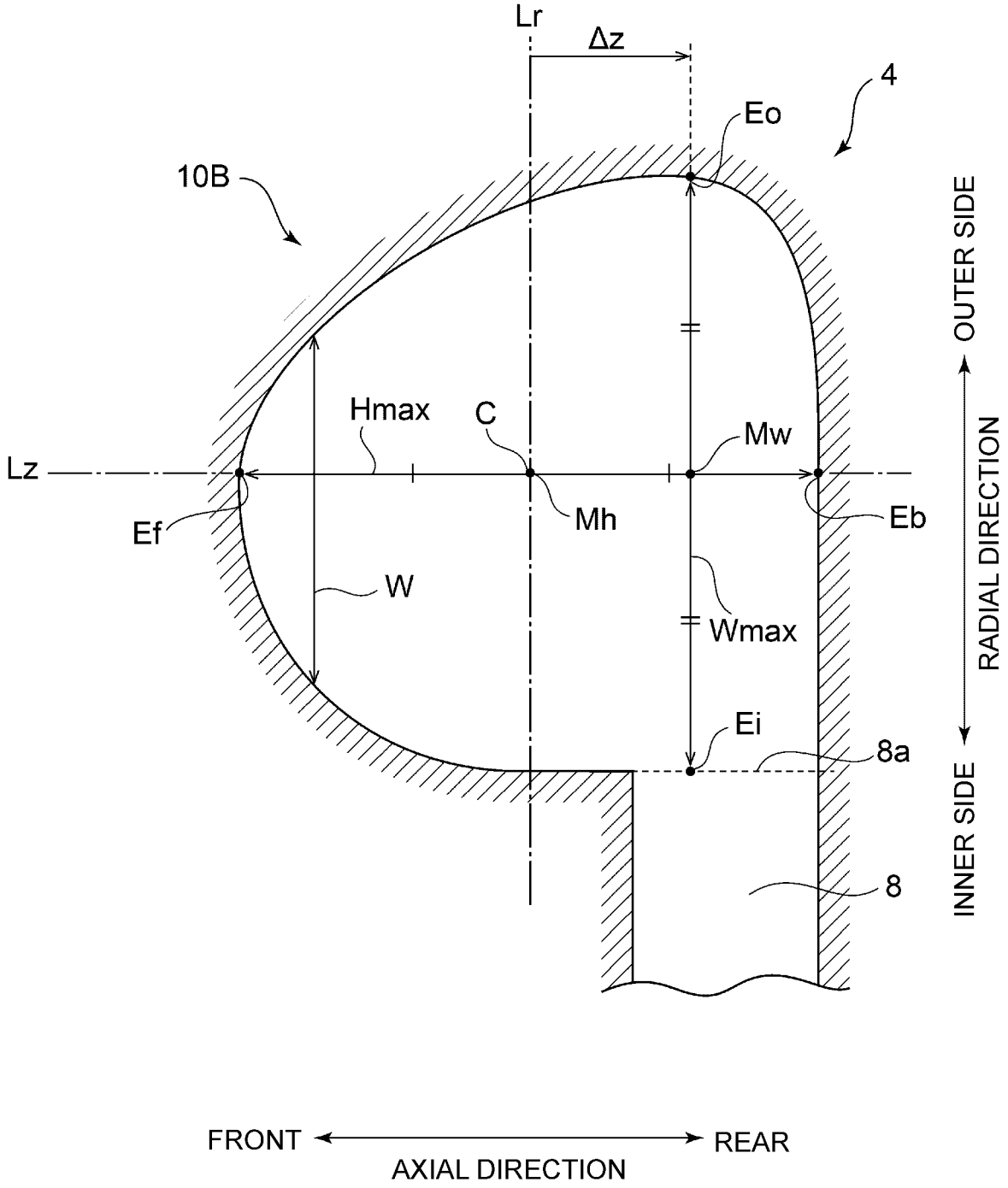
FIG. 7 is a schematic cross-sectional view for describing a shape of a recirculation flow suppressing cross section 10B according to an embodiment.
Figure 8:
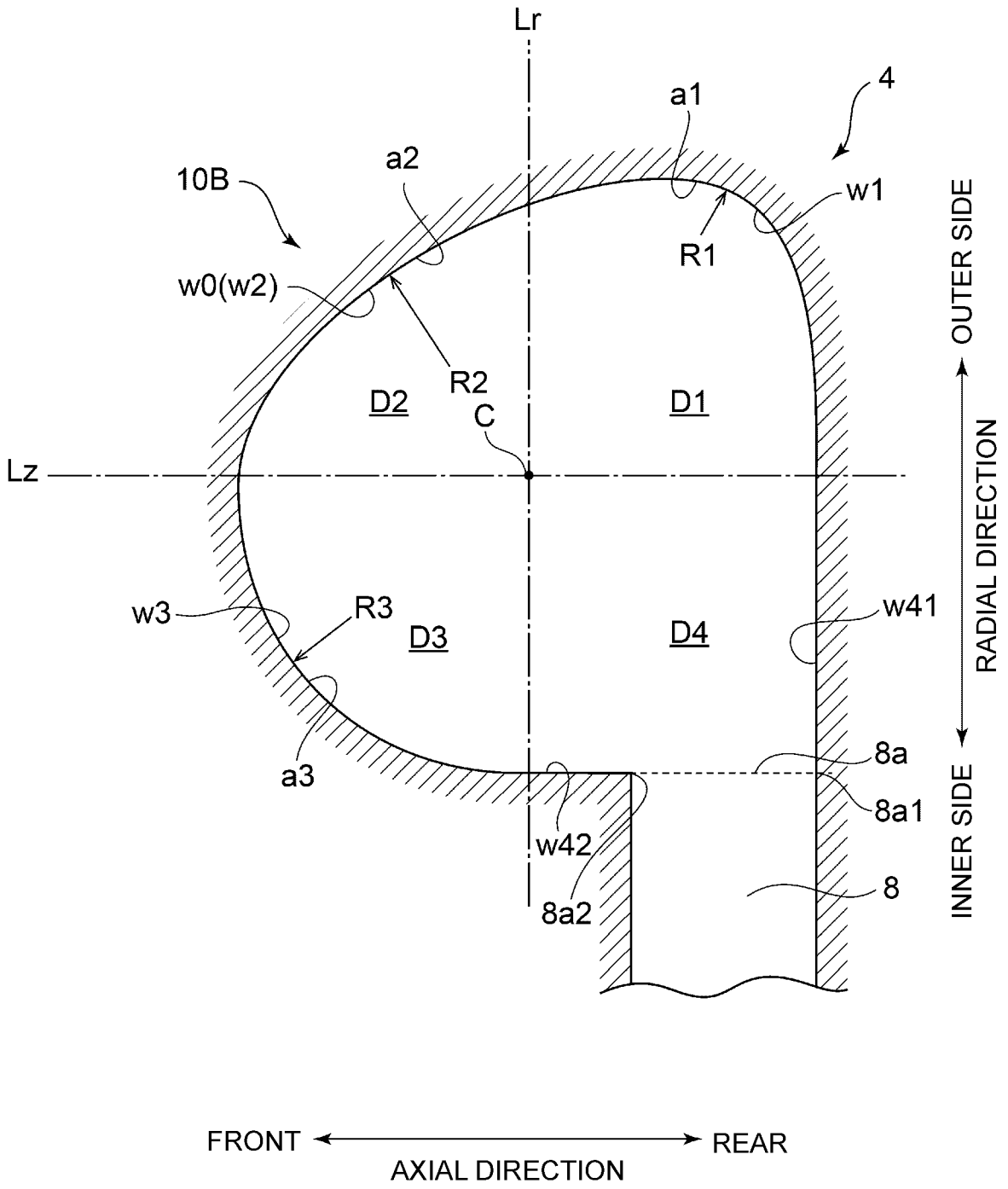
FIG. 8 is a schematic cross-sectional view for describing a shape of a recirculation flow suppressing cross section 10B according to an embodiment.

FIGS. 7 and 8 are each a schematic cross-sectional view for describing a shape of a recirculation flow suppressing cross section 10B according to an embodiment.

In an embodiment, as shown in FIG. 7, in the cross section of the scroll flow passage 4, provided that Eo is the outer end of the scroll flow passage 4 in the radial direction, Ef is the front end of the scroll flow passage 4 in the axial direction, and Mh is the middle point of the maximum flow-passage height Hmax of the scroll flow passage 4 in the axial direction, the flow passage width W of the scroll flow passage 4 in the radial direction increases gradually from the position of the front end Ef to the position of the outer end Eo with respect to the axial direction. Furthermore, in the recirculation flow suppressing cross section 10B, the outer end Eo is disposed on the back side of the middle point Mh in the axial direction.

Figure 9:
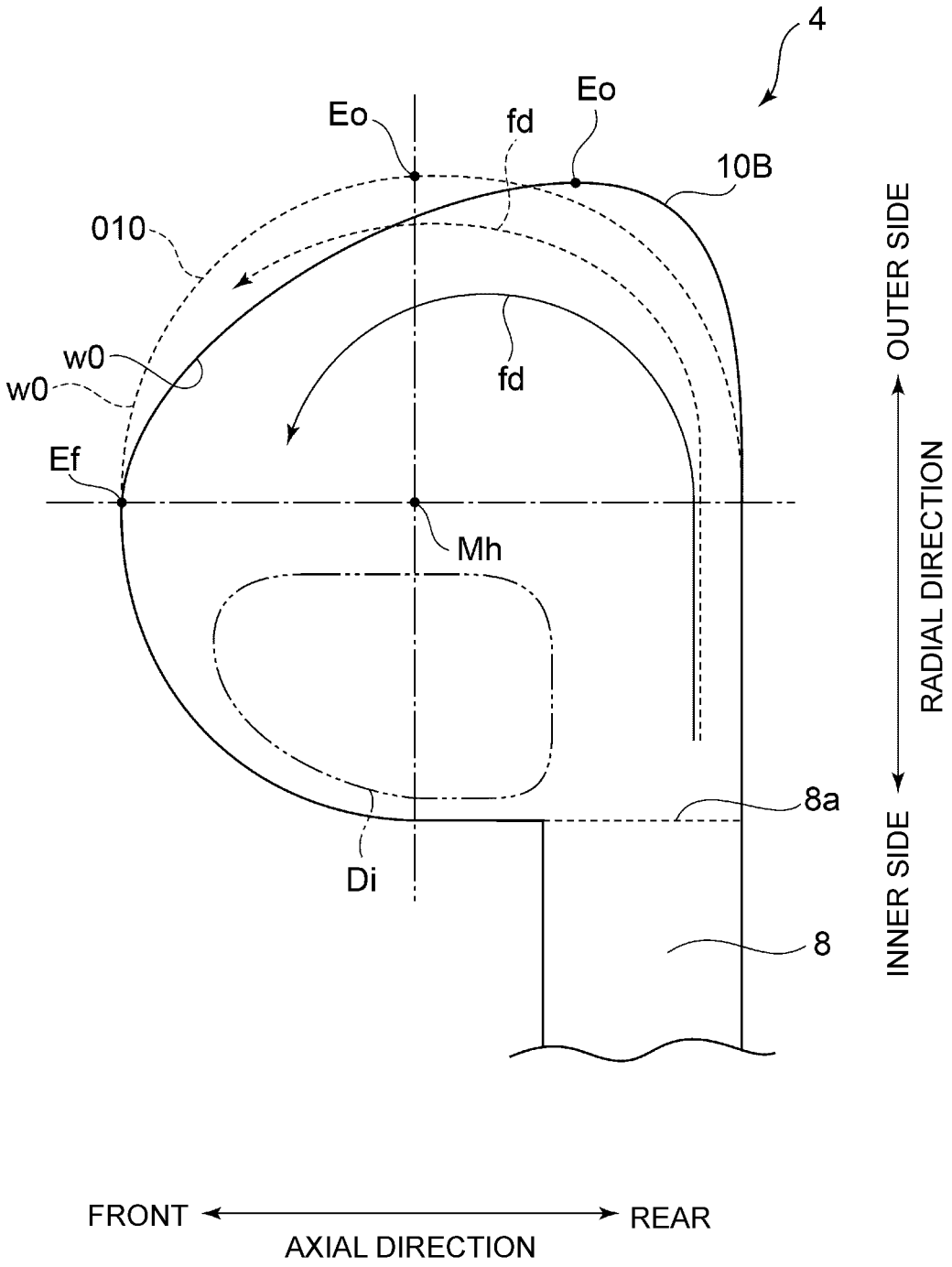
FIG. 9 is a diagram for describing the flow of the fluid fd discharged from a diffuser outlet 8*a*.

With the above configuration, in the section 's' disposed at least partially in the region closer to the scroll start 4*a* than the connection position P of the scroll start 4*a* and the scroll end 4*b* in the scroll flow passage 4, the scroll flow passage 4 has the recirculation flow suppressing cross section 10B, where the outer end Eo is disposed on the back side of the middle point Mh in the axial direction, and thereby it is possible to make the flow-passage wall portion w0 connecting the outer end Eo and the front end Ef more flat, compared to the comparative example (which has a circular cross section 010 where the front end Ef coincides with the middle point Mw over the entire region of the scroll flow passage in the circumferential direction), as shown in FIG. 9.

Thus, as shown in FIG. 9, as compared to the above comparative example, it is possible to make it easier to guide the fluid fd discharged from the diffuser outlet 8*a* to the region Di on the radially inner side (inner side in the radial direction) of the scroll flow passage 4 (in FIG. 9, the solid-line arrow fd represents the flow discharged from the diffuser outlet 8*a* in the recirculation flow suppressing cross section 10B, while the dotted-line arrow fd represents the flow discharged from the diffuser outlet 8*a* in the circular cross section 010 of the comparative example). Accordingly, it is possible to effectively suppress deviation of the flow fd from the diffuser outlet to the region on the radially outer side at the scroll start 4*a* of the scroll flow passage 4, which is the technical problem described above with reference to FIGS. 26 and 27A to 27C.

Thus, similar to the case in which the recirculation flow suppressing cross section 10A is applied to the section 's', it is possible to suppress generation of the recirculation flow fc and to suppress generation of loss that accompanies the recirculation flow fc. Furthermore, since generation of the recirculation flow fc is suppressed, it is possible to reduce the flow-passage cross-sectional area of the scroll flow passage 4 required, and to reduce the size of the scroll casing 6. Furthermore, it is possible to achieve the effect to reduce the size of the above described scroll casing and the effect to improve the surge characteristics (achievement of a wider range).

Applying the recirculation flow suppressing cross section 10A shown in FIG. 3 and the like to the section 's' has a merit of reducing pressure loss more easily than applying the recirculation flow suppressing cross section 10B shown in FIG. 7 and the like to the section 's', for the fluid discharged to the scroll flow passage 4 from the diffuser outlet 8*a* is guided smoothly to the region Di on the inner side with respect to the radial direction.

In an embodiment, at least in a part of the section 's' (see FIG. 2) having the recirculation flow suppressing cross section 10B shown in FIG. 7 formed therein, the distance $\Delta z$ between the outer end Eo and the middle point Mh in the axial direction and the maximum flow-passage height Hmax may satisfy $\Delta z \geq 0.1 \times Hmax$.

Accordingly, it is possible to enhance the effect to make it easier to guide the fluid discharged from the diffuser outlet 8*a* to the region Di on the radially inner side of the scroll flow passage 4, and to suppress generation of a recirculation flow effectively.

In yet another embodiment, the scroll flow passage 4 shown in FIG. 2 may have a recirculation flow suppressing cross section 10C described below, instead of the above described recirculation flow suppressing cross section 10A or 10B, in a section 's' disposed at least partially in the region closer to the scroll start 4*a* than the connection position P.

Figure 10:
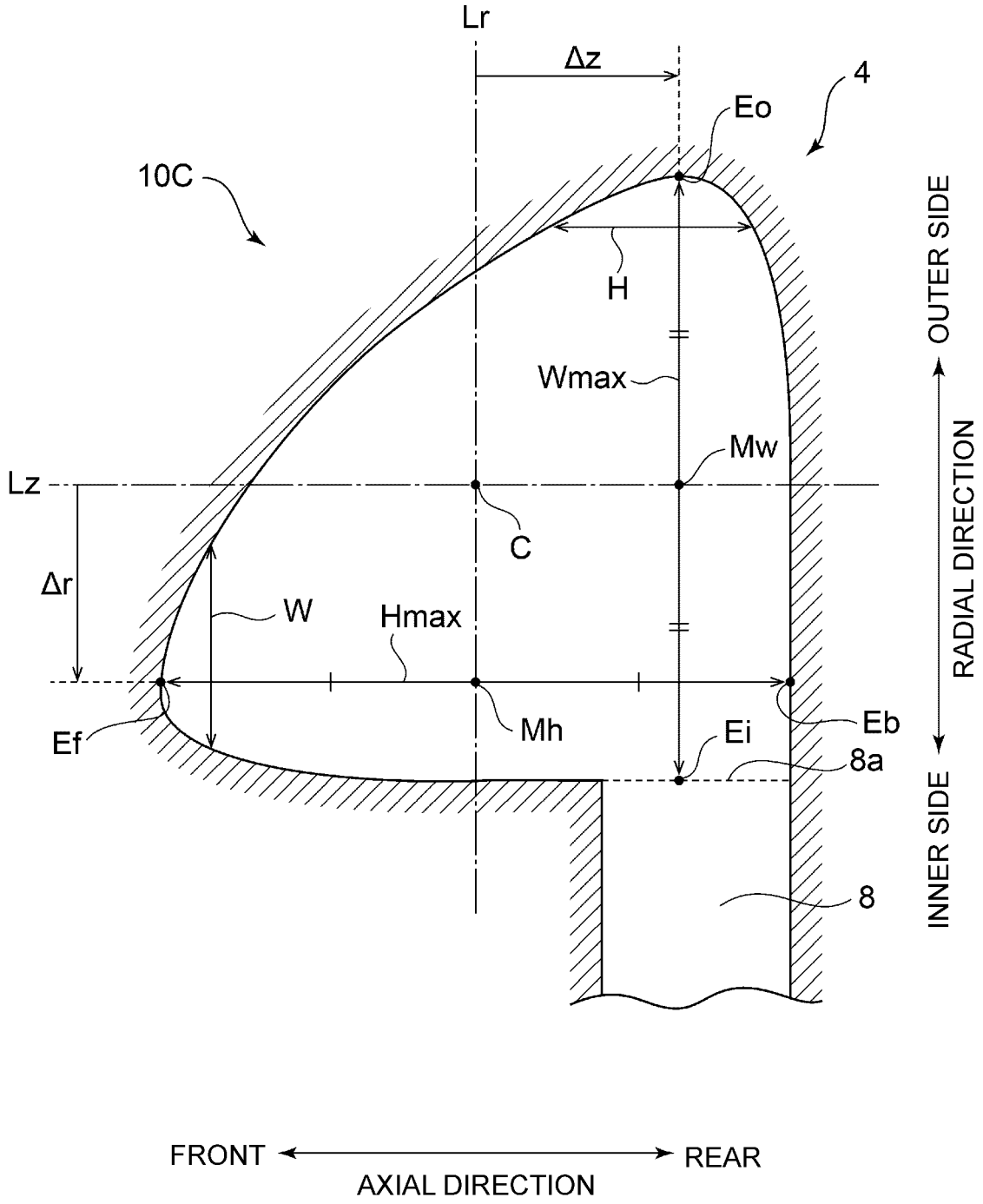
FIG. 10 is a schematic cross-sectional view for describing a shape of a recirculation flow suppressing cross section 10C according to an embodiment.
Figure 11:
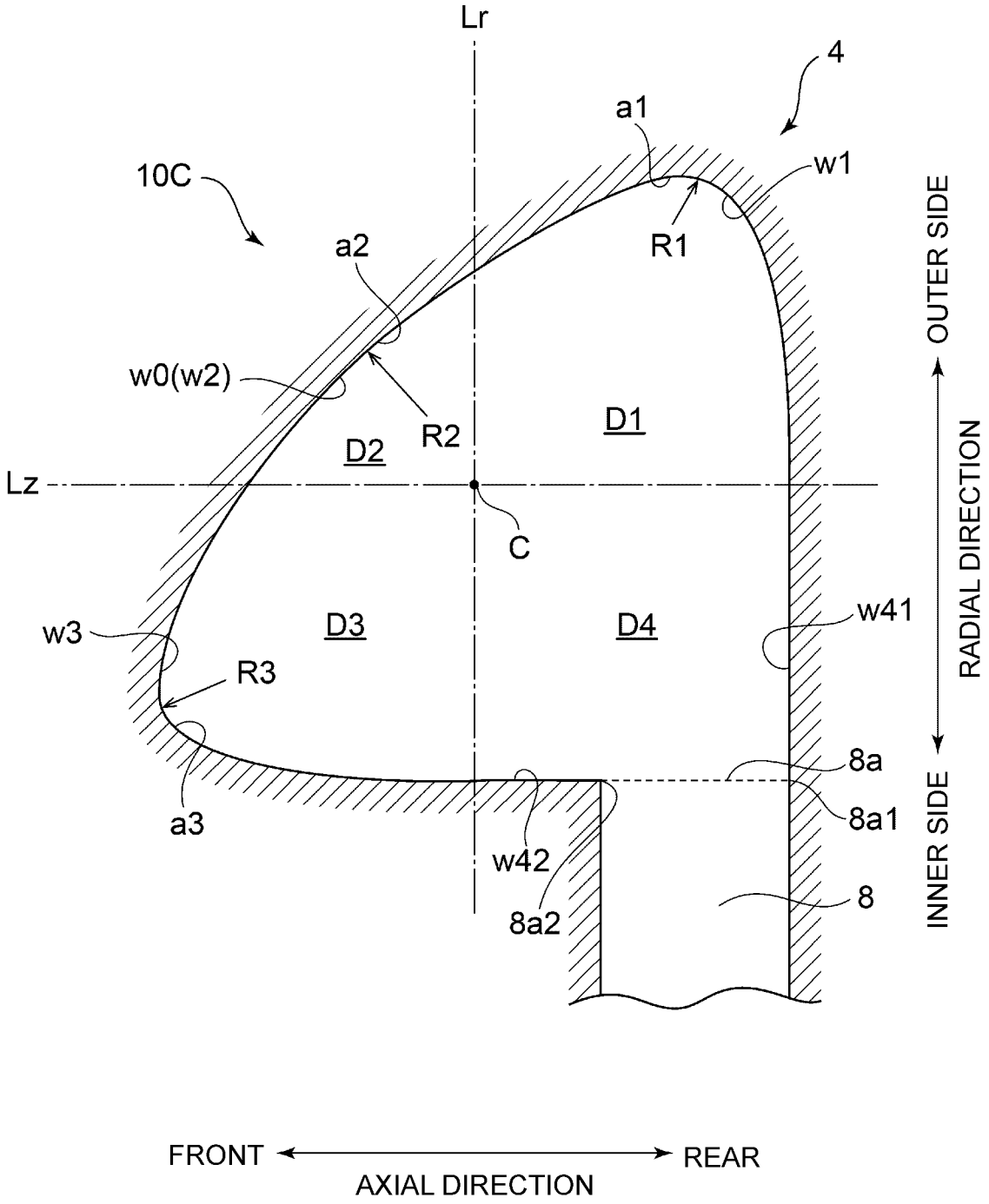
FIG. 11 is a schematic cross-sectional view for describing a shape of a recirculation flow suppressing cross section 10C according to an embodiment.

FIGS. 10 and 11 are each a schematic cross-sectional view for describing a shape of a recirculation flow suppressing cross section 10C according to an embodiment.

In an embodiment, as shown in FIG. 10 for instance, in the cross section of the scroll flow passage 4, provided that Eo is the outer end of the scroll flow passage 4 in the radial direction, Ef is the front end of the scroll flow passage 4 in the axial direction, Mw is the middle point of the maximum flow-passage width Wmax of the scroll flow passage 4 in the radial direction, and Mh is the middle point of the maximum flow-passage height Hmax of the scroll flow passage in the axial direction, the flow passage width W of the scroll flow passage 4 in the radial direction increases gradually from the position of the front end Ef to the position of the outer end Eo with respect to the axial direction, and the flow passage height H of the scroll flow passage 4 in the axial direction increases gradually from the position of the outer end Eo to the position of the front end Ef with respect to the radial direction. Furthermore, in the recirculation flow suppressing cross section 10C, the outer end Eo is disposed on the back side of the middle point Mh with respect to the axial direction, and the front end Ef is disposed on the inner side of the middle point Mw in the radial direction.

Figure 12:
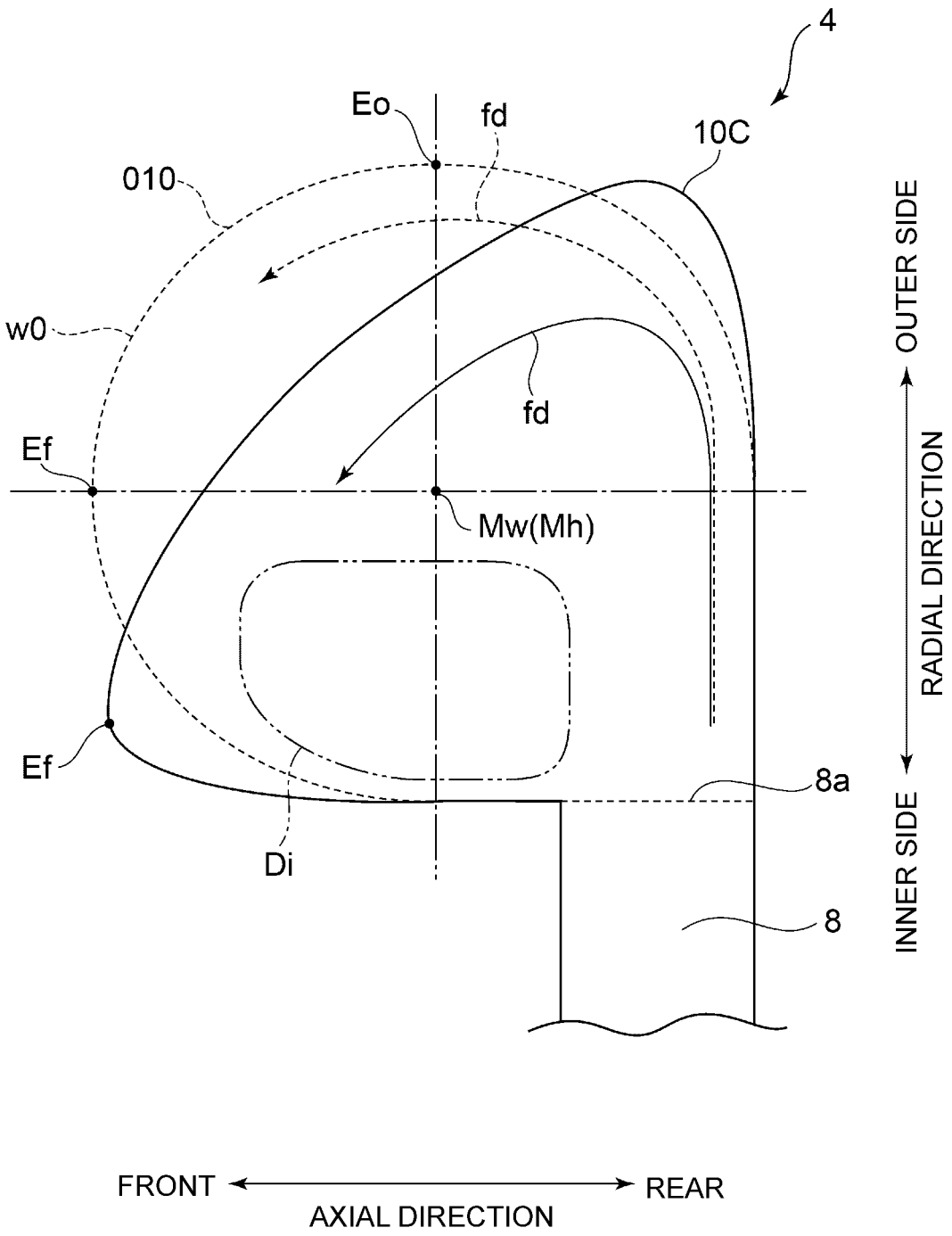
FIG. 12 is a diagram for describing the flow of the fluid fd discharged from a diffuser outlet 8*a*.

With the above configuration, as shown in FIG. 12, it is possible to make the flow-passage wall portion w0 connecting the outer end Eo and the front end Ef more flat, compared to the comparative example (which has a circular cross section 010 where the front end Ef coincides with the middle point Mw over the entire region of the scroll flow passage in the circumferential direction). Further, it is even easier to make the flow-passage wall portion w0 more flat than in a case where the recirculation flow suppressing cross section 10A or the recirculation flow suppressing cross section 10B is applied to the section 's', and thus there is a greater effect to make it easier to guide the flow fd from the diffuser outlet 8*a* to the region Di on the radially inner side of the scroll flow passage 4.

Thus, it is even more difficult for the recirculation flow to enter the region Di on the radially inner side of the scroll flow passage 4, and thereby it is possible to enhance the effect to suppress generation of the recirculation flow and generation of loss that accompanies the recirculation flow. Furthermore, corresponding to the high effect to suppress the recirculation flow, it is possible to enhance the above described effect to reduce the size of the above described scroll casing and to improve the surge characteristics (achievement of a wider range).

In an embodiment, at least in a part of the section 's' (see FIG. 2) having the recirculation flow suppressing cross section 10C shown in FIG. 7 formed therein, the distance $\Delta r$ between the front end Ef and the middle point Mw in the radial direction and the maximum flow-passage width Wmax may satisfy a relationship $\Delta r \geq 0.1 \times Wmax$, and the distance $\Delta z$ between the outer end Eo and the middle point Mh in the axial direction and the maximum flow-passage height Hmax may satisfy a relationship $\Delta z \geq 0.1 \times Hmax$.

Accordingly, it is possible to enhance the effect to make it easier to guide the fluid discharged from the diffuser outlet 8*a* to the region Di on the radially inner side of the scroll flow passage 4, and to suppress generation of a recirculation flow effectively.

In some embodiments, as shown in FIG. 4, 8, or 11, in the recirculation flow suppressing cross section 10 (10A, 10B, or 10C), in a case where Lz is a line passing through the middle point Mw of the maximum flow-passage width Wmax of the scroll flow passage in the radial direction and parallel to the axial direction, Lr is a line passing through the middle point Mh of the maximum flow-passage height Hmax of the scroll flow passage in the axial direction and parallel to the radial direction, and D1, D2, D3, D4 are four regions into which the recirculation flow suppressing cross section 10 (10A, 10B, 10C) is divided by the line Lz and the line Lr, provided that, of the four regions, A1 is the area of the region D1 positioned on the outer side in the radial direction and on the back side in the axial direction of the intersection C of the line Lz and the line Lr, A2 is the area of the region D2 positioned on the outer side in the radial direction and on the front side in the axial direction of the intersection C, and A3 is the area of the region D3 positioned on the inner side in the radial direction and on the front side in the axial direction of the intersection C, the area A1, the area A2, and the area A3 satisfy A1>A2 and A3>A2, in the section 's' (see FIG. 2) of the scroll flow passage 4 having the recirculation flow suppressing cross section 10 (10A, 10B, or 10C).

With the above configuration, it is possible to make the flow-passage wall portion w0 connecting the outer end Eo and the front end Ef more flat, compared to the comparative example (which has a circular cross section 010 that satisfies A1=A2=A3), and to make it easier to guide the fluid fd discharged from the diffuser outlet 8*a* to the region Di on the radially inner side of the scroll flow passage 4. Accordingly, it is more difficult for the recirculation flow to enter the region Di on the radially inner side of the scroll flow passage 4, and thereby it is possible to suppress generation of the recirculation flow and to suppress generation of loss that accompanies the recirculation flow.

In some embodiments, as shown in FIG. 4, 8, or 11, in the recirculation flow suppressing cross section 10 (10A, 10B, or 10C), the flow-passage wall portion w1 belonging to the region D1 includes an arc portion a1 having the first curvature radius R1, the flow-passage wall portion w2 belonging to the region D2 includes an arc portion a2 having the second curvature radius R2 greater than the first curvature radius R1, and the flow-passage wall portion w3 belonging to the region D3 includes an arc portion a3 having the third curvature radius smaller than the second curvature radius R2. In the region D4, provided are a flow-passage wall portion w41 connecting the axial-directional back end 8*a*1 of the diffuser outlet 8*a* to the flow-passage wall portion w1, and a flow-passage wall portion w42 connecting the flow-passage wall portion w3 to the axial-directional front end 8*a*2 of the diffuser outlet 8*a*.

With the above configuration, the arc portion a2 of the flow-passage wall portion w2 belonging to the region D2 is closer to flat than the arc portion a1 and the arc portion a3, compared to the comparative example (which has a circular cross section 010 that satisfies R1=R2=R3), and thus it is possible to make it easier to guide the fluid fd discharged from the diffuser outlet 8*a* to the region Di on the radially inner side of the scroll flow passage 4, as shown in FIG. 5, 9, or 12. Accordingly, it is more difficult for the recirculation flow to enter the region Di on the radially inner side of the scroll flow passage 4, and thereby it is possible to suppress generation of the recirculation flow and to suppress generation of loss that accompanies the recirculation flow.

In some embodiments, as shown in FIG. 2, provided that the angular position about the scroll center O of the scroll flow passage 4 is zero degree at the connection position P and an angular position at a position closer to the scroll start side than the connection position P is θ, the section 's' in which the recirculation flow suppressing cross section 10 (10A, 10B, or 10C) is provided may be at least a part of the section from θ=zero degree to θ=120 degrees in the scroll flow passage 4.

Accordingly, by applying the recirculation flow suppressing cross section 10 (10A, 10B, or 10C) to the section closer to the scroll start than the connection position P but still close to the connection position P to some extent in the scroll flow passage 4, it is possible to suppress deviation of the above described flow fd to the region on the radially outer side at the scroll start of the scroll flow passage 4 effectively. Accordingly, it is possible to suppress generation of the recirculation flow effectively.

In some embodiments, in the scroll flow passage 4 shown in FIG. 2, the recirculation flow suppressing cross section 10 (10A, 10B, or 10C) may be disposed from θ=0 degree to the first angular position θ1 in the scroll flow passage 4.

Accordingly, by applying the recirculation flow suppressing cross section 10 (10A, 10B, or 10C) to the section 's' closer to the scroll start than the connection position P in the scroll flow passage 4, it is possible to suppress deviation of the above described flow fd to the region on the radially outer side at the scroll start of the scroll flow passage 4 effectively. Accordingly, it is possible to suppress generation of the recirculation flow effectively.

In some embodiments, the above first angular position θ1 may be an angular position of 10 degrees or more (more preferably, 30 degrees or more).

According to findings of the present inventors, by applying the recirculation flow suppressing cross section 10 (10A, 10B, or 10C) to the section before the fluid discharged from the diffuser outlet 8*a* swirls at least approximately once about the cross-sectional center of the scroll flow passage 4 in the vicinity of the connection position P (scroll start side) in the scroll flow passage 4, it is possible to effectively suppress deviation of the flow fd from the diffuser outlet to the region Do on the radially outer side at the scroll start 004*a* of the scroll flow passage 004, which is the technical problem described above with reference to FIGS. 26 and 27A to 27C. While the distance the fluid discharged from the diffuser outlet 8*a* requires to complete approximately one rotation changes depending on the operational conditions, with the first angular position θ1 being not less than 10 degrees (more preferably, not less than 30 degrees), it is possible to suppress deviation of the flow to the region on the radially outer side at the scroll start 4*a* of the scroll flow passage 4 more effectively, and to suppress generation of the recirculation flow more effectively.

Figure 13:
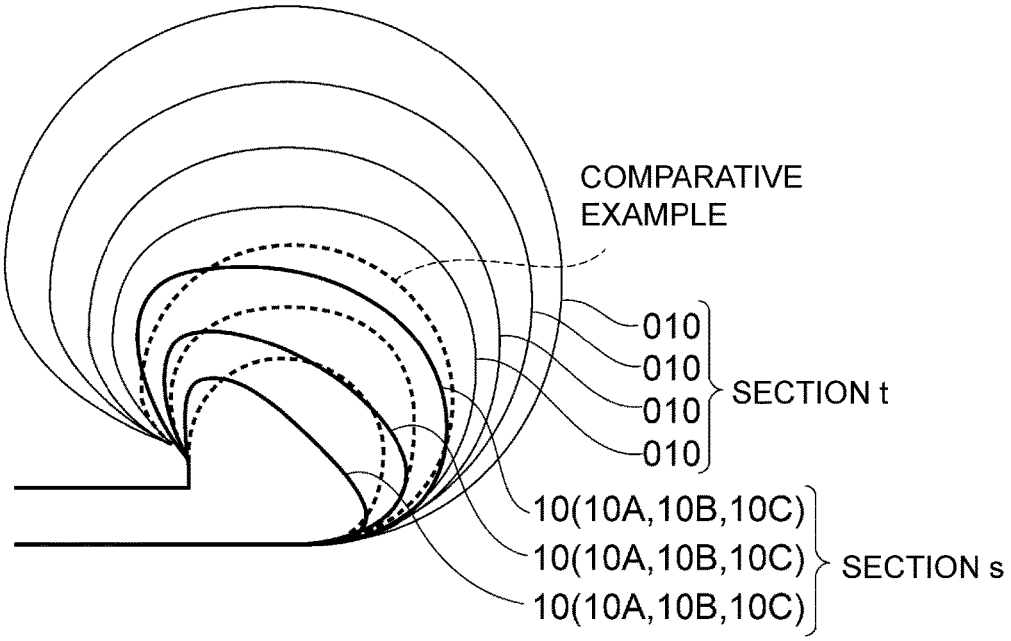
FIG. 13 is a diagram comparing the cross-sectional shape of the scroll flow passage 4 according to an embodiment and the cross-sectional shape of the scroll flow passage according to a comparative example.

In some embodiments, as shown in FIGS. 2 and 13, of the scroll flow passage 4, the section 't' downstream of the section 's' having the recirculation flow suppressing cross section 10 (10A, 10B, or 10C) may have a circular cross-sectional shape (e.g. the above described circular cross section 010).

Figure 14:
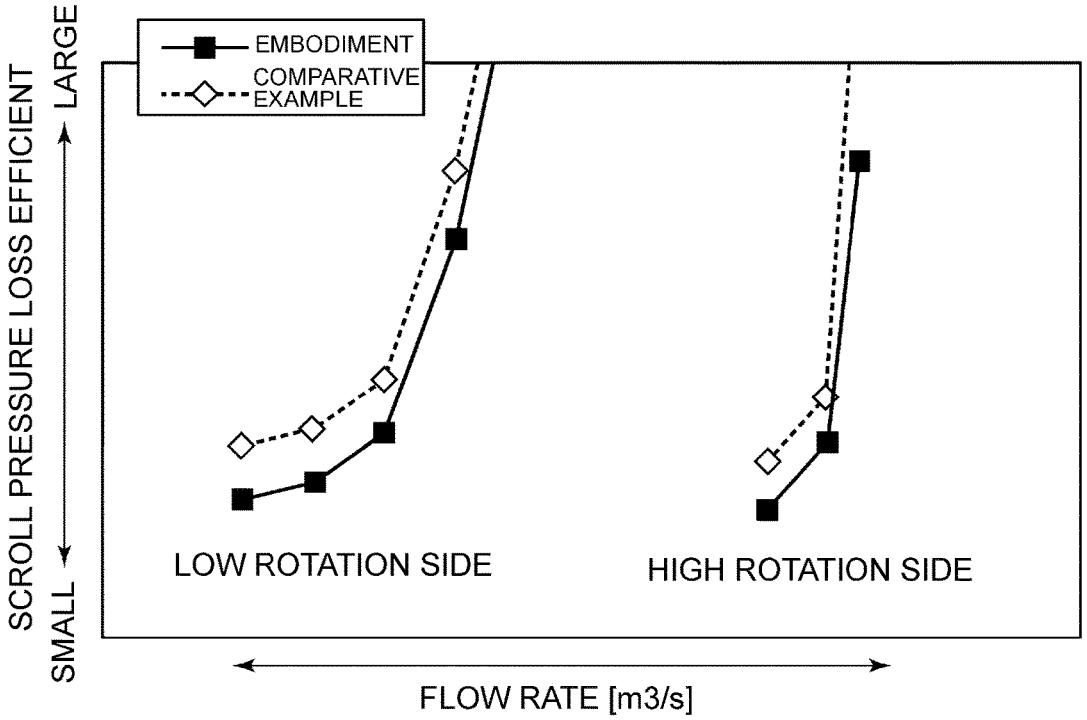
FIG. 14 is a comparative diagram of the relationship of the flow rate and the pressure loss coefficient of the recirculation flow at the low-rotation side and the high-rotation side, between an embodiment and a comparative example.

With the above configuration, compared to the comparative example in which the entire section of the scroll flow passage has a circular cross-sectional shape, it is possible to guide the flow from the diffuser outlet 8*a* in the scroll flow passage 4 quickly to the above described region Di, where the flow is typically unlikely to enter, by applying the recirculation flow suppressing cross section 10 (10A, 10B, or 10C) to the section 's', and to form a smooth swirl flow with the circular cross-sectional shape in the section 't' separated downstream (toward the scroll start side) from the connection position P to some extent, and thereby it is possible to reduce flow loss inside the scroll flow passage 4 while reducing the amount of recirculation flow. Accordingly, as shown in FIG. 14, in the entire operational range at the small flow rate side, the large flow rate side, the low rotation side and the high rotation side, it is possible to reduce the pressure loss coefficient compared to the above embodiment.

Figure 15:
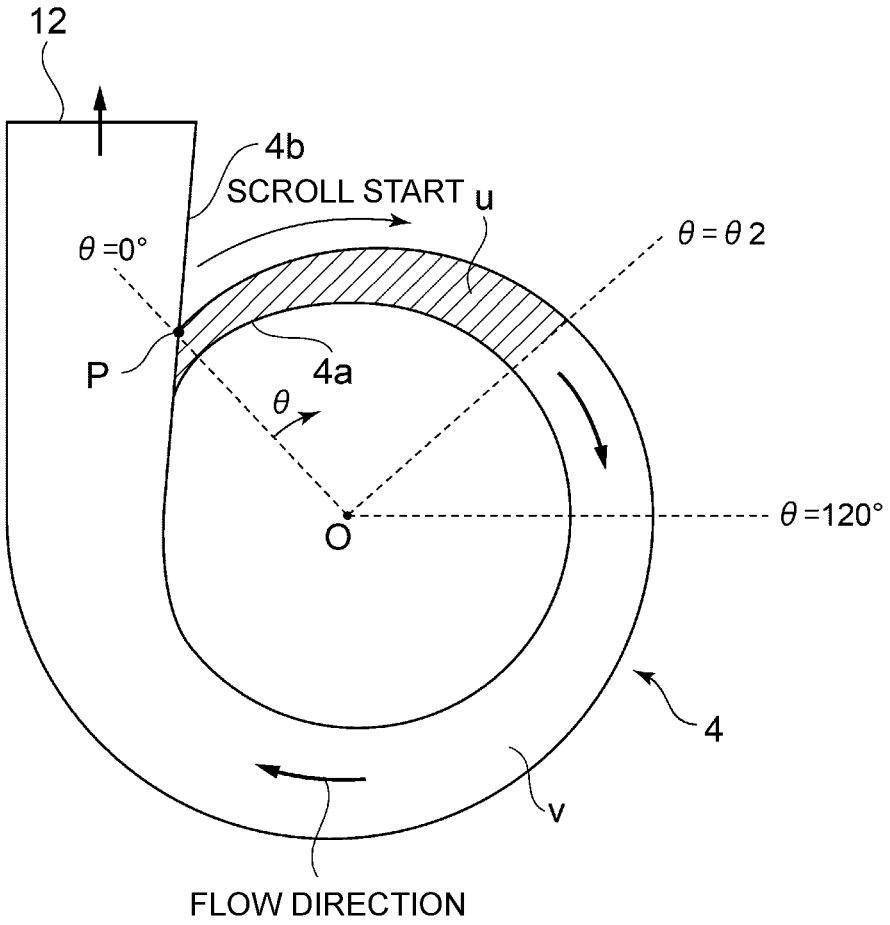
FIG. 15 is a schematic diagram of a scroll flow passage 4 in the axial directional view of the centrifugal compressor 100 according to an embodiment.
Figure 16:
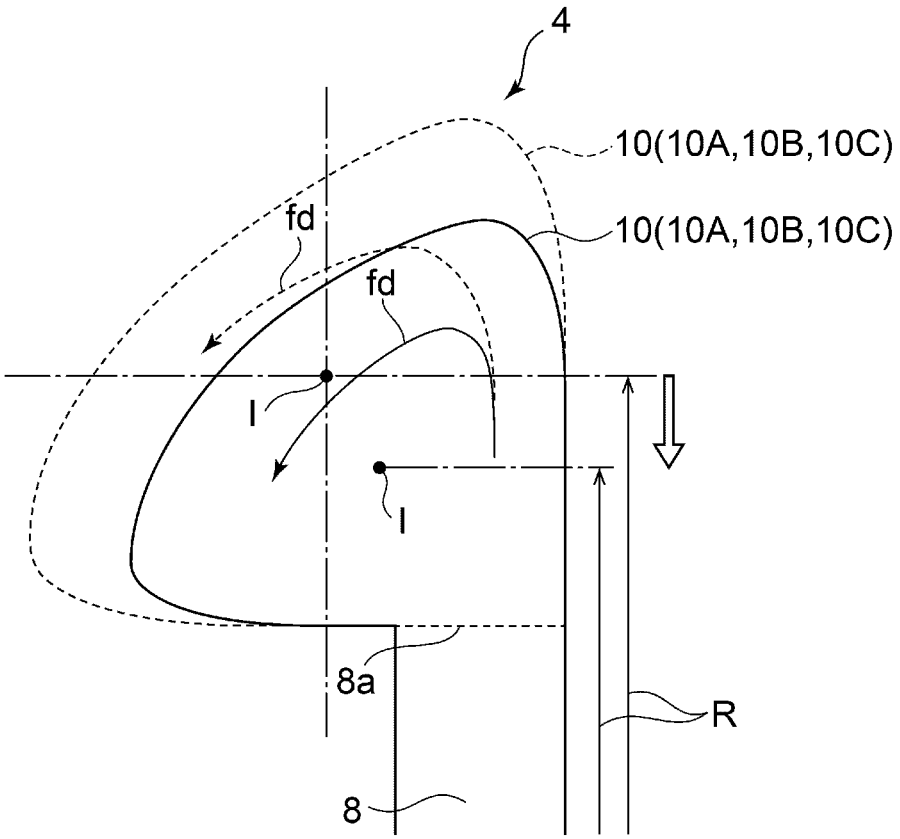
FIG. 16 is a diagram showing the change of the cross-sectional shape of the scroll flow passage 4 in the centroid-position shift section 'u'.
Figure 17:
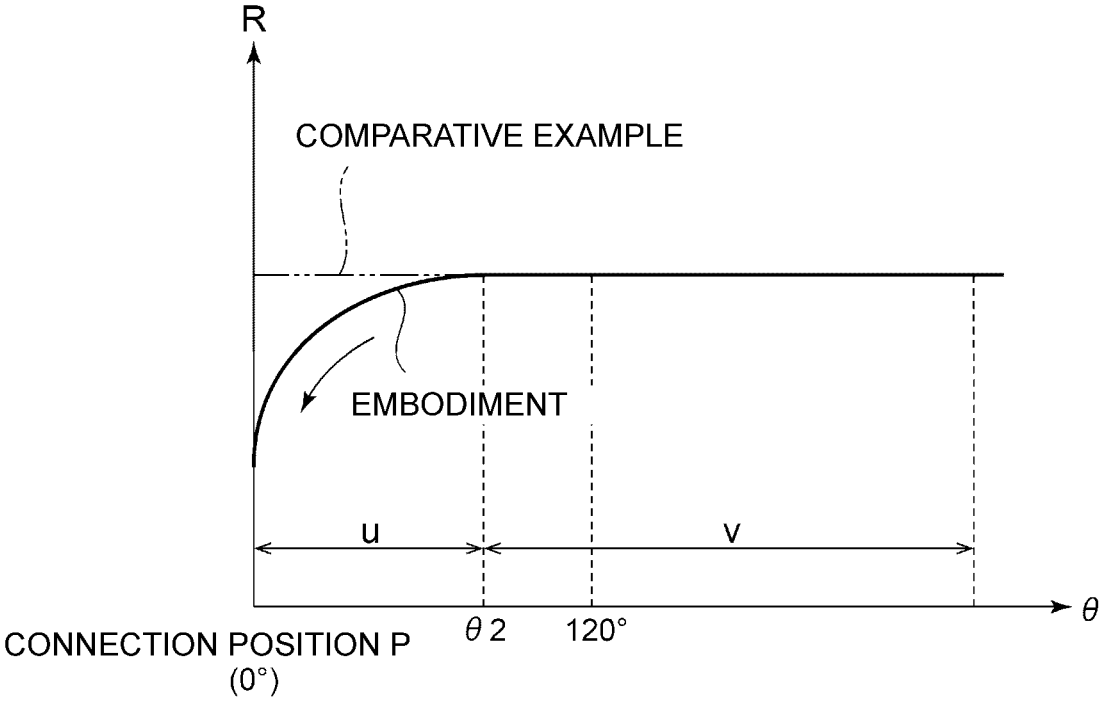
FIG. 17 is a diagram showing the relationship between the angular position θ and the distance R between the centroid I of the cross section of the scroll flow passage 4 and the rotational axis O of the centrifugal compressor 100.

In some embodiments, as shown in FIGS. 15 to 17, the scroll flow passage 4 may include a centroid position shift section 'u' where the distance R between the centroid I of the cross section and the scroll center O of the scroll flow passage (e.g. the rotational axis O of the impeller 2; see FIG. 1) reduces toward the connection position P from the downstream side (as the angular position decreases), in the section 'u' disposed at least partially in the region closer to the scroll start than the connection position P of the scroll start 4*a* and the scroll end 4*b*. In FIG. 16, in the centroid position shift section 'u', the solid line represents the recirculation flow suppressing cross section 10 (10A, 10B, or 10C) positioned relatively upstream, and the dotted line represents the recirculation flow suppressing cross section 10 (10A, 10B, or 10C) positioned relatively downstream.

Figure 18:
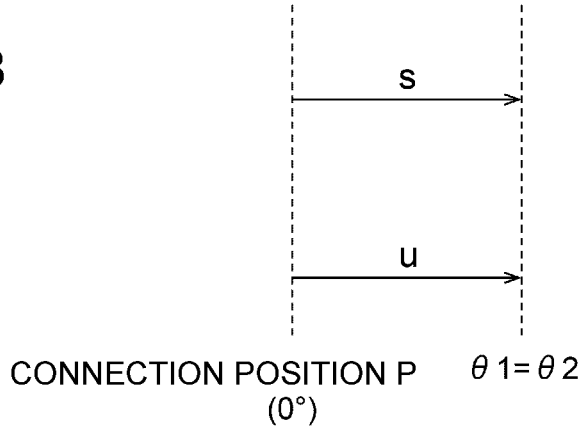
FIG. 18 is a diagram showing an example of the relationship between the section 's' and the section 'u'.
Figure 19:
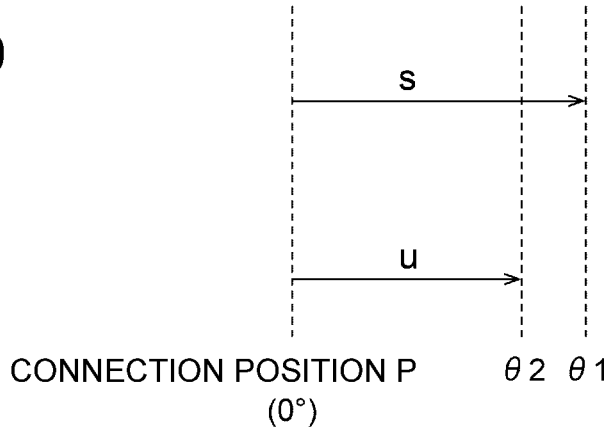
FIG. 19 is a diagram showing an example of the relationship between the section 's' and the section 'u'.
Figure 20:
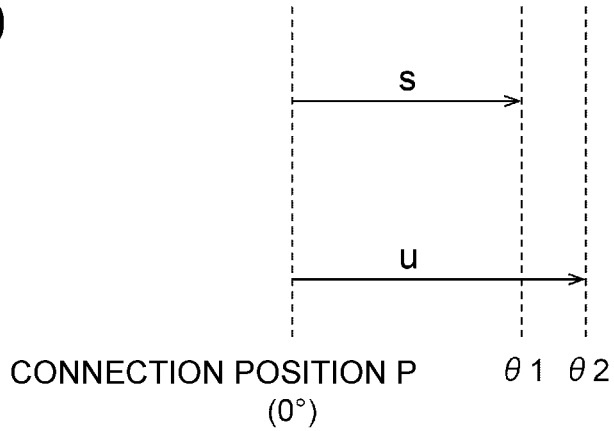
FIG. 20 is a diagram showing an example of the relationship between the section 's' and the section 'u'.

In this case, in some embodiments, as shown in FIGS. 18 to 20, the section 's' with the recirculation flow suppressing cross section 10 (10A, 10B, or 10C) and the centroid position shift section 'u' may be partially overlapped with each other. That is, the section 's' and the section 'u' may coincide as shown in FIG. 18; the angular position θ2 defining the section 'u' may be smaller than the angular position θ1 defining the section 's' as shown in FIG. 19; or the angular position θ2 defining the section 'u' may be greater than the angular position θ1 defining the section 's' as shown in FIG. 20. Further, the section 'v' downstream of the centroid position shift section 'u' in the scroll flow passage 4 may be a centroid position constant section where the distance R is constant.

With the above configuration, in the centroid position shift section 'u' in the scroll flow passage 4, the distance R between the centroid I of the cross section and the scroll center O reduces toward the connection position P from the downstream side, and thus it is possible to enhance the above effect (achieved by applying the recirculation flow suppressing cross section 10) to make it easier to guide the flow discharged from the diffuser outlet 8*a* to the region Di (see FIG. 5, 9, or 12) on the radially inner side of the scroll flow passage 4. Accordingly, it is possible to effectively suppress deviation of the flow to the region on the radially outer side at the scroll start of the scroll flow passage 4.

In some embodiments, as shown in FIGS. 15 and 17, the centroid position shift section 'u' may be disposed in at least a part of the section from θ=zero degree to θ=120 degrees in the scroll flow passage 4.

Accordingly, with the centroid position shift section 'u' disposed in the section closer to the scroll start than the connection position P in the scroll flow passage 4 and still close to the connection position P, it is possible to effectively suppress deviation of the flow fd from the diffuser outlet to the region on the radially outer side at the scroll start 4*a* of the scroll flow passage 4, which is the technical problem described above with reference to FIGS. 26 and 27A to 27C. Accordingly, it is possible to suppress generation of the recirculation flow effectively.

In some embodiments, as shown in FIGS. 15 and 17, the centroid position shift section 'u' may be disposed from θ=zero degree to the second angular position θ2 in the scroll flow passage 4.

Accordingly, with the section starting from the connection position P and extending toward the scroll start in the scroll flow passage 4 being the centroid position shift section 'u', it is possible to suppress deviation of the flow to the region on the radially outer side at the scroll start of the scroll flow passage effectively. Accordingly, it is possible to suppress generation of the recirculation flow effectively.

In some embodiments, the second angular position θ2 may be an angular position of 10 degrees or greater.

According to findings of the present inventors, by applying the centroid position shift section 'u' so as to cover to some extent the section before the fluid discharged from the diffuser outlet 8*a* swirls at least approximately once about the cross-sectional center of the scroll flow passage 4 in the vicinity of the connection position P (scroll start side) in the scroll flow passage 4, it is possible to effectively suppress deviation of the flow to the region on the radially outer side at the scroll start 4*a* of the scroll flow passage 4. While the distance the fluid discharged from the diffuser outlet 8*a* requires to complete approximately one rotation changes depending on the operational conditions, with the second angular position θ2 being an angular position of not less than 10 degrees (more preferably, not less than 30 degrees), it is possible to suppress deviation of the flow to the region on the radially outer side at the scroll start 4*a* of the scroll flow passage 4 more effectively, and to suppress generation of the recirculation flow more effectively.

Figure 21:
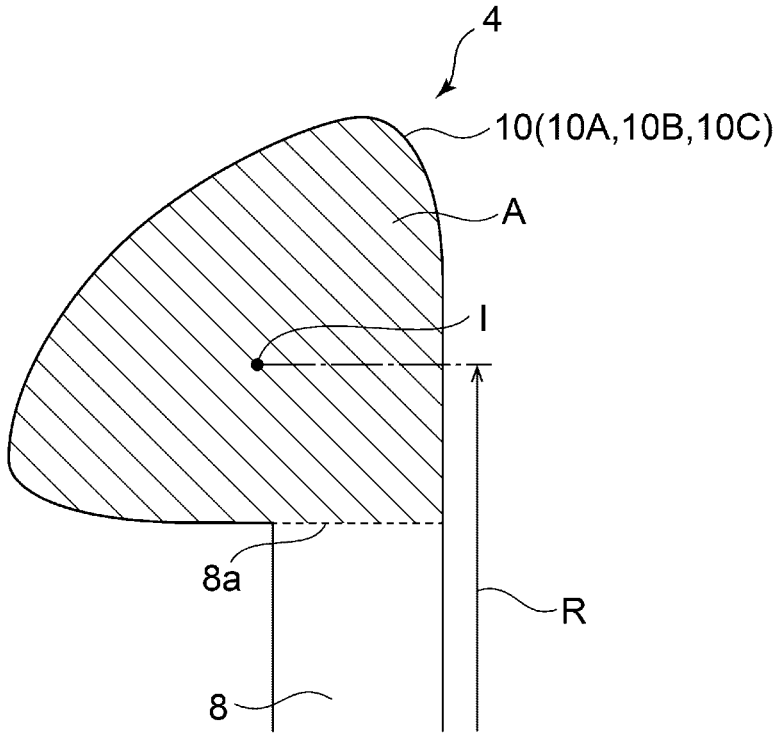
FIG. 21 is a schematic cross-sectional view showing the flow-passage cross-sectional area A and the distance R of the scroll flow passage 4.
Figure 22:
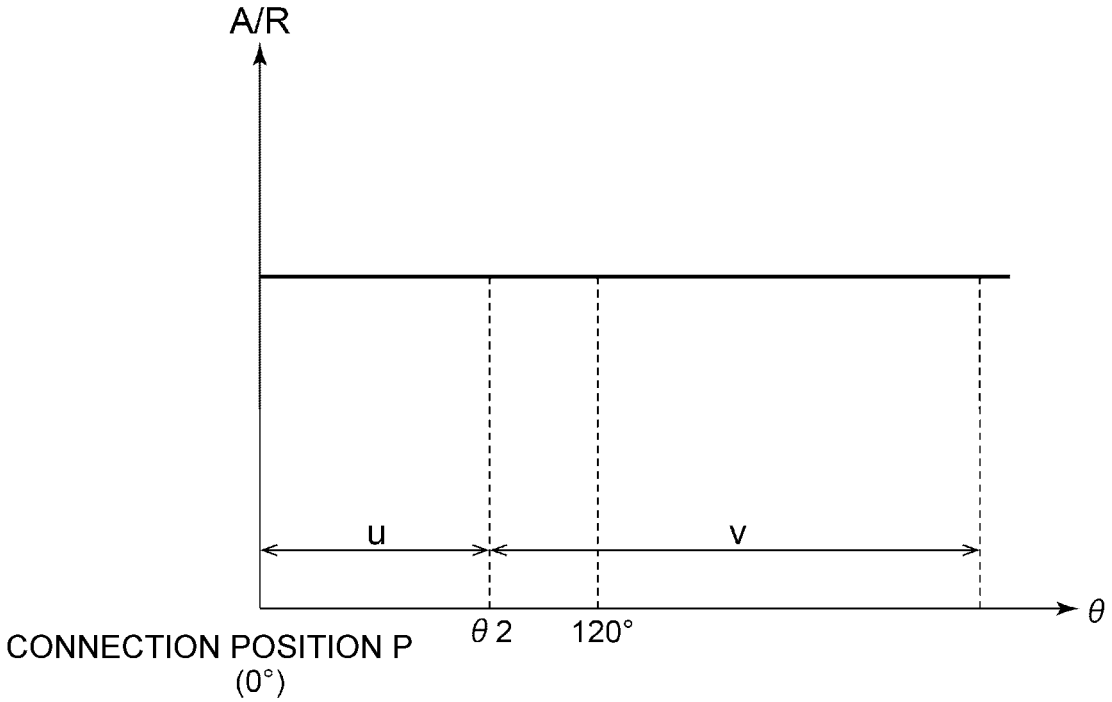
FIG. 22 is a diagram showing the relationship between the angular position θ and A/R.

In some embodiments, as shown in FIGS. 21 and 22, provided that A is the flow-passage cross-sectional area of the scroll flow passage 4 (flow-passage cross-sectional area defined in a case where the diffuser outlet 8*a* is the boundary between the scroll flow passage 4 and the diffuser flow passage 8), in the centroid position shift section 'u', the value A/R obtained by dividing the flow-passage cross-sectional area by the distance R increases at a substantially constant gradient from the scroll start 4*a* to the scroll end 4*b* of the scroll flow passage 4.

With the above configuration, in the centroid position shift section 'u', the value A/R is constant regardless of the angular position θ about the scroll center O, and thus it is possible to enhance the above effect to make it easier to guide the fluid discharged from the diffuser outlet 8*a* to the region Di on the radially inner side of the scroll flow passage 4, while maintaining a constant flow velocity regardless of the angular position θ. Accordingly, it is possible to suppress generation of the recirculation flow effectively while maintaining a constant flow velocity regardless of the angular position θ.

Embodiments of the present invention were described in detail above, but the present invention is not limited thereto, and various amendments and modifications may be implemented.

Figure 23:
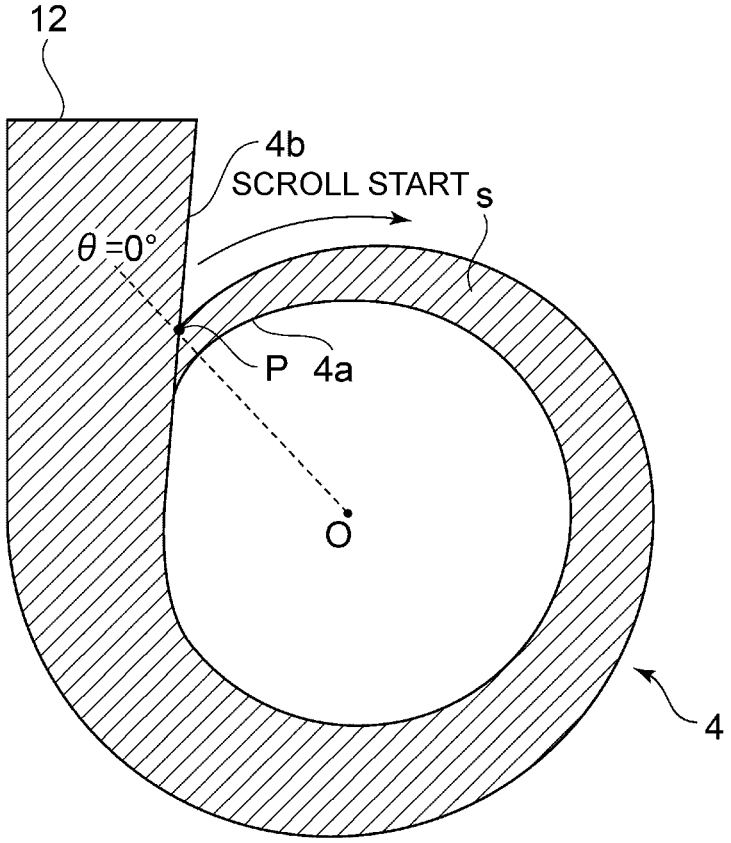
FIG. 23 is a schematic diagram of a scroll flow passage 4 in the axial directional view of the centrifugal compressor 100 according to an embodiment.

For instance, while the section 's' having the recirculation flow suppressing cross section 10 (10A, 10B, or 10C) and the section 'u' having the circular cross section 010 disposed downstream of the section 's' are shown in the embodiment shown in FIG. 2, the section 's' having the recirculation flow suppressing cross section 10 (10A, 10B, or 10C) shown in FIG. 23 may be provided over the entire region in the circumferential direction of the scroll flow passage 4.

Similarly with the above configuration, it is possible to suppress deviation of the flow to the region on the radially outer side at the scroll start 4*a* of the scroll flow passage 4 effectively, and thereby it is possible to suppress generation of the recirculation flow and to suppress generation of loss that accompanies the recirculation flow. Furthermore, since generation of the recirculation flow is suppressed, it is possible to reduce the flow-passage cross-sectional area of the scroll flow passage required, and to reduce the size of the scroll casing. Furthermore, it is possible to improve the surge characteristics (achieve a wider range), similarly.

DESCRIPTION OF REFERENCE NUMERALS

2 Impeller
4 Scroll flow passage
4*a* Scroll start
4*b* Scroll end
6 Scroll casing
8 Diffuser flow passage
8*a* Diffuser outlet
8*a*1 Back end
8*a*2 Front end
10 (10A, 10B, 10C) Recirculation flow suppressing cross section
12 Outlet of scroll flow passage
100 Centrifugal compressor
A Flow-path cross sectional area
A1, A2, A3 Area
C Intersection
D1, D2, D3, D4, Di, Do Region
Ef Front end
Eo Outer end
I Centroid
Lr, Lz Line
Mh, Mw Middle point
O Rotational axis
P Connection position (tongue section position)
R1 First curvature radius
R2 Second curvature radius
R3 Third curvature radius
W Flow passage width
Wmax Maximum flow-passage width
H Flow passage height
Hmax Maximum flow-passage height
a1, a2, a3 Arc portion
fd Fluid flow from diffuser outlet
fc Recirculation flow
s, t, u, v Section
w0, w1, w2, w31, w32, w4 Flow-passage wall portion

The invention claimed is:

1. A scroll casing which forms a scroll flow passage of a centrifugal compressor, wherein, in a cross section of the scroll flow passage, Eo is an outer end of the scroll flow passage in a radial direction of the centrifugal compressor, Ef is a front end of the scroll flow passage in an axial direction of the centrifugal compressor, Mw is a middle point of a maximum flow-passage width Wmax of the scroll flow passage in the radial direction, Lz is a line passing through a middle point Mw of a maximum flow-passage width Wmax of the scroll flow passage in the radial direction and parallel to the axial direction, Lr is a line passing through a middle point Mh of a maximum flow-passage height Hmax of the scroll flow passage in the axial direction and parallel to the radial direction, and C is an intersection of the line Lz and the line Lr, a flow passage height H of the scroll flow passage in the axial direction gradually increases from a position of the outer end Eo to a position of the front end Ef with respect to the radial direction, the scroll flow passage has a recirculation flow suppressing cross section in which the front end Ef is disposed on an inner side, in the radial direction, of the middle point Mw, in a section disposed at least partially in a region closer to a scroll start than a connection position of the scroll start and a scroll end, and a distance from a rotational axis of the centrifugal compressor to Mh in the radial direction is shorter than a distance from the rotational axis to the intersection C in the radial direction.

2. The scroll casing according to claim 1, wherein a flow passage width W of the scroll flow passage in the radial direction gradually increases from a position of the front end Ef toward a position of the outer end Eo with respect to the axial direction, and wherein, in the recirculation flow suppressing cross section, the outer end Eo is disposed on a back side, in the axial direction, of the middle point Mh.

3. The scroll casing according to claim 1, wherein, at least in a part of a section of the scroll flow passage having the recirculation flow suppressing cross section, the maximum flow-passage width Wmax and a distance $\Delta r$ between the front end Ef and the middle point Mw in the radial direction satisfies $\Delta r \geq 0.1 \times$ Wmax.

4. The scroll casing according to claim 1, wherein, an angular position about a scroll center of the scroll flow passage is zero degree at the connection position and the angular position is $\theta$ at a position closer to the scroll start than the connection position, the recirculation flow suppressing cross section is disposed in at least a part of a section from $\theta$=zero degree to $\theta$=120 degrees in the scroll flow passage.

5. The scroll casing according to claim 1, wherein, an angular position about a scroll center of the scroll flow passage is zero degree at the connection position and the angular position is $\theta$ at a position closer to the scroll start than the connection position, the recirculation flow suppressing cross section is disposed from $\theta$=zero degree to a first angular position $\theta$1 in the scroll flow passage.

6. The scroll casing according to claim 5, wherein the first angular position $\theta$1 is an angular position of not less than 10 degrees.

7. The scroll casing according to claim 1, wherein the scroll flow passage includes a section having a circular cross-sectional shape at downstream of the first angular position $\theta$1.

8. The scroll casing according to claim 1, wherein the recirculation flow suppressing cross section is disposed over an entire region in a circumferential direction of the scroll flow passage.

9. The scroll casing according to claim 1, wherein, in the cross section of the scroll flow passage, the recirculation flow suppressing cross section is divided into four regions by the line Lz and the line Lr, of the four regions, A1 is an area of a region positioned on an outer side in the radial direction and on a back side in the axial direction of an intersection C of the line Lz and the line Lr, A2 is an area of a region positioned on the outer side in the radial direction and on a front side in the axial direction of the intersection, and A3 is an area of a region positioned on an inner side in the radial direction and on a front side in the axial direction of the intersection, the area A1, the area A2, and the area A3 satisfy A1>A2 and A3>A2, in at least a part of a section of the scroll flow passage, the section having the recirculation flow suppressing cross section.

10. The scroll casing according to claim 1, wherein, in the cross section of the scroll flow passage, the recirculation flow suppressing cross section is divided into four regions by the line Lz and the line Lr, a flow-passage wall of a region positioned on an outer side in the radial direction and on a back side in the axial direction of the intersection C of the line Lz and the line Lr, of the four regions, includes an arc portion having a first curvature radius R1, a flow-passage wall of a region positioned on an outer side in the radial direction and on a front side in the axial direction of the intersection C, of the four regions, includes an arc portion having a second curvature radius R2 which is greater than the first curvature radius R1, and a flow-passage wall of a region positioned on an inner side in the radial direction and on a front side in the axial direction of the intersection C, of the four regions, includes an arc portion having a third curvature radius R3 which is smaller than the second curvature radius R2.

11. The scroll casing according to claim 1, wherein, that R is a distance between a centroid of the recirculation flow suppressing cross section and a scroll center of the scroll flow passage, the scroll flow passage includes, in a section disposed at least partially in a region closer to the scroll start than the connection position of the scroll start and the scroll end, a centroid position shift section where the distance R decreases from a downstream side, with respect to a flow direction, toward the connection position, and the section including the recirculation flow suppressing cross section and the centroid position shift section overlap with each other at least partially.

12. The scroll casing according to claim 11, wherein, an angular position about the scroll center of the scroll flow passage is zero degree at the connection position and the angular position at a position closer to the scroll start than the connection positions is θ, the centroid position shift section is disposed at least partially in a section from θ=zero degree to θ=120 degrees in the scroll flow passage.

13. The scroll casing according to claim 11, wherein, A is a flow-passage area of the recirculation flow suppressing cross section, in the centroid position shift section, A/R obtained by dividing the flow-passage cross sectional area A by the distance R increases at a constant gradient from the scroll start to the scroll end of the scroll flow passage.

14. The scroll casing according to claim 1, wherein, an angular position about a scroll center of the scroll flow passage is zero degree at the connection position and the angular position is θ at a position closer to the spiral start than from the connection position, a centroid position shift section is disposed from θ=zero degree to the second singular position θ2 in the scroll flow passage.

15. The scroll casing according to claim 14, wherein the second angular position θ2 is an angular position of not less than 10 degrees.

16. A centrifugal compressor, comprising:

an impeller; and the scroll casing according to claim 1, the scroll casing being disposed around the impeller and forming a scroll flow passage into which a fluid flows after passing through the impeller.

17. A scroll casing which forms a scroll flow passage of a centrifugal compressor, wherein, in a cross section of the scroll flow passage, Eo is an outer end of the scroll flow passage in a radial direction of the centrifugal compressor, Ef is a front end of the scroll flow passage in an axial direction of the centrifugal compressor, Mh is a middle point of a maximum flow-passage height Hmax of the scroll flow passage in the axial direction, and Lz is a line passing through a middle point Mw of a maximum flow-passage width Wmax of the scroll flow passage in the radial direction and parallel to the axial direction, Lr is a line passing through a middle point Mh of a maximum flow-passage height Hmax of the scroll flow passage in the axial direction and parallel to the radial direction, Mw is a middle point of a maximum flow-passage width Wmax of the scroll flow passage in the radial direction, and C is an intersection of the line Lz and the line Lr, a flow passage width W of the scroll flow passage in the radial direction gradually increases from a position of the front end Ef to a position of the outer end Eo with respect to the axial direction, the scroll flow passage has a recirculation flow suppressing cross section in which the outer end Eo is disposed on a back side, in the axial direction, of the middle point Mh, in a section disposed at least partially in a region closer to a scroll start than a connection position of the scroll start and a scroll end, and Mw is located on a side opposite to Ef in the axial direction with respect to the intersection C.

18. The scroll casing according to claim 17, wherein, at least in a part of a section of the scroll flow passage having the recirculation flow suppressing cross section, the maximum flow-passage height Hmax and a distance Δz between the outer end Eo and the middle point Mh in the axial direction satisfies $\Delta z \geq 0.1 \times Hmax$.

* * * * *